US012590348B2

(12) United States Patent
Takeda et al.

(10) Patent No.: US 12,590,348 B2
(45) Date of Patent: Mar. 31, 2026

(54) STEEL SHEET AND METHOD FOR PRODUCING SAME

(71) Applicant: NIPPON STEEL CORPORATION, Tokyo (JP)

(72) Inventors: Kengo Takeda, Tokyo (JP); Katsuya Nakano, Tokyo (JP); Yuya Suzuki, Tokyo (JP); Eriko Tsukamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 601 days.

(21) Appl. No.: 17/924,627

(22) PCT Filed: Jun. 3, 2021

(86) PCT No.: PCT/JP2021/021263

§ 371 (c)(1),
(2) Date: Nov. 10, 2022

(87) PCT Pub. No.: WO2021/251276

PCT Pub. Date: Dec. 16, 2021

(65) Prior Publication Data

US 2023/0183834 A1 Jun. 15, 2023

(30) Foreign Application Priority Data

Jun. 8, 2020 (JP) ..... 2020-099261

(51) Int. Cl.

| | |
|---|---|
| ***C21D 9/46*** | (2006.01) |
| ***B21C 47/02*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/06*** | (2006.01) |
| ***C23C 2/12*** | (2006.01) |
| ***C23C 2/40*** | (2006.01) |
| ***C23G 1/08*** | (2006.01) |

(52) U.S. Cl.

CPC ..... *C21D 9/46* (2013.01); *B21C 47/02* (2013.01); *C21D 8/0226* (2013.01); *C21D 8/0236* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C23C 2/06* (2013.01); *C23C 2/12* (2013.01); *C23C 2/40* (2013.01); *C23G 1/08* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search

None

See application file for complete search history.

(56) References Cited

U.S. PATENT DOCUMENTS

| | | | | |
|---|---|---|---|---|
| 2016/0108492 | A1* | 4/2016 | Zhong ..... | C21D 9/46 148/320 |
| 2018/0010226 | A1 | 1/2018 | Ikeda et al. | |
| 2018/0044748 | A1 | 2/2018 | Takagi et al. | |
| 2018/0298462 | A1 | 10/2018 | Sano et al. | |
| 2019/0003009 | A1 | 1/2019 | Kawata et al. | |

FOREIGN PATENT DOCUMENTS

| | | | |
|---|---|---|---|
| EP | 3 309 273 | A1 | 4/2018 |
| JP | 2000246322 | A * | 9/2000 |
| JP | 2013-60630 | A | 4/2013 |
| JP | 2016-130355 | A | 7/2016 |
| JP | 2017-57460 | A | 3/2017 |

* cited by examiner

*Primary Examiner* — Jenny R Wu

(74) *Attorney, Agent, or Firm* — Birch, Stewart, Kolasch & Birch, LLP

(57) ABSTRACT

Provided is a steel sheet having a predetermined chemical composition and microstructure, wherein a block size in a first depth region of 1 to 10 μm from the surface is 5.0 μm or less, a block size in a second depth region of 10 to 60 μm from the surface is 6.0 to 20.0 μm, and a block size in a third depth region of 60 μm to ¼ thickness from the surface is less than 6.0 μm. Further, provided is a method for producing a steel sheet comprising a step of hot rolling a steel slab having a predetermined chemical composition, then coiling it at 500° C. or more, a step of pickling the hot rolled steel sheet to remove oxide scale, wherein an amount of removal of the surface layer of the hot rolled steel sheet is less than 5.00 μm, a step of cold rolling by a rolling reduction of 30 to 90%, and an annealing step of holding in an atmosphere of a dew point of −20 to 20° C. at a temperature region of 740 to 900° C. for 40 to 300 seconds.

10 Claims, No Drawings

STEEL SHEET AND METHOD FOR PRODUCING SAME

FIELD

The present invention relates to a steel sheet high in strength and excellent in weldability and a method for producing the same.

BACKGROUND

When using a spot welder to weld galvanized steel sheet, sometimes the melted zinc causes the steel sheet to crack. Such a crack is called an "LME crack (liquid metal embrittlement crack)" and occurs due to molten zinc penetrating to the inside of the steel sheet along the grain boundaries of the steel.

Up until now, numerous inventions have been disclosed relating to high strength steel sheet, but among them, there have been few examples of disclosures of art relating to the suppression of spot welding LME cracks. (For example, see PTLs 1 and 2.)

PTL 1 discloses steel sheet raised in strength and galling resistance by making fine oxides including Si and/or Mn disperse in a surface layer of the steel sheet so as to raise the hardness and discloses the art of controlling hot rolling conditions so as to cause the formation of the oxides at the surface layer of the steel sheet and of controlling the pickling conditions so as to not completely remove the oxides. However, PTL 1 does not disclose the art of suppressing LME.

PTL 2 discloses steel sheet improved in the balance of strength and ductility, bendability, and delayed fracture resistance by providing an internal oxide layer having a certain depth in a surface layer of the steel sheet and making it function as a hydrogen trap site and soften the surface layer and discloses the art of annealing the steel sheet in an oxidizing and reducing atmosphere while leaving in a certain thickness the internal oxide layer formed in hot rolling even after pickling and cold rolling. However, PTL 2 does not in any way disclose the art of suppressing LME.

CITATION LIST

Patent Literature

[PTL 1] Japanese Unexamined Patent Publication No. 2013-60630

[PTL 2] Japanese Unexamined Patent Publication No. 2016-130355

SUMMARY

Technical Problem

The present invention, in consideration of the above situation, has as its object the provision of a steel sheet high in strength and excellent in weldability and a method for producing the same.

Solution to Problem

The inventors engaged in intensive research on the solution to the above problem and clarified that "strain" has a great effect on the occurrence of LME cracks. For example, even in the same current application cycle (heat history), LME cracks remarkably occur if spot welding so as to increase the amount of plastic deformation of steel sheet. It is believed that the reason why LME cracks more easily occur along with an increase in "strain" is that "penetration of molten zinc to the inside of the steel sheet" as stated above more easily occurs. Therefore, by preventing an increase of strain at the surface layer of the steel sheet, it becomes possible to suppress the occurrence of spot welding LME cracks. The inventors discovered the means of imparting a difference in strength in a thickness direction so as to prevent an increase in strain at the surface layer of steel sheet. Specifically, they discovered that when steel sheet is subjected to rapid heating at the time of spot welding, the austenite grain size is affected by a block size of the material before welding and made the block size of a surface-most layer (first layer) finer, gave a soft layer (second layer) of a large block size at the inside of the hard surface-most layer at the inside in the thickness side, and, further, provided a hard layer (third layer) of a block size finer than the soft layer at the inside in thickness. By forming a three-layer structure controlled in block size to a gradient from the surface layer in thickness to a center layer in thickness, even at the time of spot welding, at the time of deformation, the soft layer with the large block size (second layer) mainly bears the strain and it becomes possible to keep down an excessive increase in strain at the surface-most layer (first layer). Further, along with this, by providing a difference in block size in the thickness direction, at the time of hole expansion, cracks are kept from spreading to the surface-most layer, therefore a high hole expandability can be obtained.

Further, the inventors learned through an accumulation of various research that steel sheet of a layer structure provided with a suitable difference in block size in the thickness direction is difficult to produce if just slightly changing the hot rolling conditions, annealing conditions, etc., and can only be produced by optimizing the conditions in the integrated steps of the hot rolling and annealing steps, etc., and thereby completed the present invention.

The gist of the present invention is as follows.

(1) A steel sheet having a chemical composition comprising, by mass %,

C: 0.20 to 0.40%,
Si: 0.01 to 1.00%,
Mn: 0.10 to 4.00%,
P: 0.0200% or less,
S: 0.0200% or less,
Al: 1.000% or less,
N: 0.0200% or less,
Co: 0 to 0.5000%,
Ni: 0 to 1.0000%,
Mo: 0 to 1.0000%,
Cr: 0 to 2.0000%,
O: 0 to 0.0200%,
Ti: 0 to 0.500%,
B: 0 to 0.0100%,
Nb: 0 to 0.5000%,
V: 0 to 0.5000%,
Cu: 0 to 0.5000%,
W: 0 to 0.1000%,
Ta: 0 to 0.1000%,
Sn: 0 to 0.0500%,
Sb: 0 to 0.0500%,
As: 0 to 0.0500%,
Mg: 0 to 0.0500%,
Ca: 0 to 0.0500%,
Y: 0 to 0.0500%,
Zr: 0 to 0.0500%, La: 0 to 0.0500%,
Ce: 0 to 0.0500%, and
a balance of Fe and impurities, and
a microstructure containing, by area ratio,
a total of ferrite, pearlite, and bainite: 0 to 10.0% and
a total of martensite and tempered martensite: 80.0 to 100.0%,
wherein in a cross-sectional structure taken in a width direction perpendicular to a rolling direction,
a block size in a first depth region of 1 to 10 μm from the surface is 5.0 μm or less,
a block size in a second depth region of 10 to 60 μm from the surface is 6.0 to 20.0 μm, and
a block size in a third depth region of 60 μm to ¼ thickness from the surface is less than 6.0 μm.

(2) The steel sheet according to the above (1), wherein the chemical composition comprises, by mass %, one or more selected from the group consisting of
Co: 0.0001 to 0.5000%,
Ni: 0.0001 to 1.0000%,
Mo: 0.0001 to 1.0000%,
Cr: 0.0001 to 2.0000%,
O: 0.0001 to 0.0200%,
Ti: 0.0001 to 0.500%,
B: 0.0001 to 0.0100%,
Nb: 0.0001 to 0.5000%,
V: 0.0001 to 0.5000%,
Cu: 0.0001 to 0.5000%,
W: 0.0001 to 0.1000%,
Ta: 0.0001 to 0.1000%,
Sn: 0.0001 to 0.0500%,
Sb: 0.0001 to 0.0500%,
As: 0.0001 to 0.0500%,
Mg: 0.0001 to 0.0500%,
Ca: 0.0001 to 0.0500%,
Y: 0.0001 to 0.0500%,
Zr: 0.0001 to 0.0500%,
La: 0.0001 to 0.0500%, and
Ce: 0.0001 to 0.0500%.

(3) The steel sheet according to the above (1) or (2), wherein an area ratio of retained austenite in the microstructure is 10.0% or less.

(4) The steel sheet according to any one of the above (1) to (3), wherein a plating layer containing zinc, aluminum, magnesium, an alloy consisting of any combination thereof, or an alloy of at least one of these elements and iron is formed on at least one surface of the steel sheet.

(5) A method for producing a steel sheet comprising
a step of hot rolling a steel slab having a chemical composition according to the above (1) or (2), then coiling it at 500° C. or more,
a step of pickling the obtained hot rolled steel sheet to remove oxide scale present on the surface of the hot rolled steel sheet, wherein an amount of removal of the surface layer of the hot rolled steel sheet is less than 5.00 μm,
a step of cold rolling the hot rolled steel sheet by a rolling reduction of 30 to 90%, and
an annealing step of holding the obtained cold rolled steel sheet in an atmosphere of a dew point of −20 to 20° C. at a temperature region of 740 to 900° C. for 40 to 300 seconds.

(6) The method for producing the steel sheet according to the above (5), wherein, in the annealing step, a plating layer containing zinc, aluminum, magnesium, an alloy consisting of any combination thereof, or an alloy of at least one of these elements and iron is formed on at least one surface of the cold rolled steel sheet.

Advantageous Effects of Invention

According to the present invention, it is possible to provide a steel sheet high in strength and excellent in weldability and a method for producing the same.

DESCRIPTION OF EMBODIMENTS

Below, embodiments of the present invention will be explained. These explanations are intended to simply illustrate the embodiments of the present invention. The present invention is not limited to the following embodiments.

<Steel Sheet>

The steel sheet according to an embodiment of the present invention has a chemical composition comprising, by mass %,
C: 0.20 to 0.40%,
Si: 0.01 to 1.00%,
Mn: 0.10 to 4.00%,
P: 0.0200% or less,
S: 0.0200% or less,
Al: 1.000% or less,
N: 0.0200% or less,
Co: 0 to 0.5000%,
Ni: 0 to 1.0000%,
Mo: 0 to 1.0000%,
Cr: 0 to 2.0000%,
O: 0 to 0.0200%,
Ti: 0 to 0.500%,
B: 0 to 0.0100%,
Nb: 0 to 0.5000%,
V: 0 to 0.5000%,
Cu: 0 to 0.5000%,
W: 0 to 0.1000%,
Ta: 0 to 0.1000%,
Sn: 0 to 0.0500%,
Sb: 0 to 0.0500%,
As: 0 to 0.0500%,
Mg: 0 to 0.0500%,
Ca: 0 to 0.0500%,
Y: 0 to 0.0500%,
Zr: 0 to 0.0500%,
La: 0 to 0.0500%,
Ce: 0 to 0.0500%, and
a balance of Fe and impurities, and
a microstructure containing, by area ratio,
a total of ferrite, pearlite, and bainite: 0 to 10.0% and
a total of martensite and tempered martensite: 80.0 to 100.0%,
wherein in a cross-sectional structure taken in a width direction perpendicular to a rolling direction,
a block size in a first depth region of 1 to 10 μm from the surface is 5.0 μm or less,
a block size in a second depth region of 10 to 60 μm from the surface is 6.0 to 20.0 μm, and
a block size in a third depth region of 60 μm to ¼ thickness from the surface is less than 6.0 μm.

First, the reasons for limiting the chemical composition of the steel sheet according to an embodiment of the present invention will be explained. The "%" of the constituents here means mass %. Further, in this Description, the "to" showing a range of numerical values is used in the sense including the numerical values before and after it as lower limit values and upper limit values unless otherwise indicated.

(C: 0.20 to 0.40%)

C is an element making the tensile strength increase inexpensively and is an extremely important element for control of the strength of the steel. To sufficiently obtain such an effect, the C content is 0.20% or more. The C content may also be 0.22% or more, 0.24% or more, or 0.28% or more. On the other hand, if excessively including C, sometimes the occurrence of LME is promoted. For this reason, the C content is 0.40% or less. The C content may also be 0.38% or less, 0.36% or less, or 0.34% or less.

(Si: 0.01 to 1.00%)

Si is an element acting as a deoxidizer and suppressing the precipitation of carbides in a cooling process during cold rolled annealing. To sufficiently obtain such an effect, the Si content is 0.01% or more. The Si content may also be 0.05% or more, 0.10% or more, or 0.20% or more. On the other hand, if excessively including Si, an increase in the steel strength and a drop in the hole expandability are invited and further coarse oxides become dispersed at the surface layer of the hot rolled steel sheet and the desired grain size distribution can no longer be obtained at the surface layer of the steel sheet after the cold rolled annealing, therefore the LME resistance is sometimes made to fall. For this reason, the Si content is 1.00% or less. The Si content may also be 0.90% or less, 0.80% or less, or 0.70% or less.

(Mn: 0.10 to 4.00%)

Mn is a factor affecting the ferrite transformation of steel and is an element effective for raising the strength. To sufficiently obtain such an effect, the Mn content is 0.10% or more. The Mn content may also be 0.50% or more, 0.90% or more, or 1.50% or more. On the other hand, if excessively including Mn, an increase in the steel strength and a drop in the hole expandability are invited and further coarse oxides become dispersed at the surface layer of the hot rolled steel sheet and the desired grain size distribution can no longer be obtained at the surface layer of the steel sheet after cold rolled annealing, therefore the LME resistance is sometimes made to fall. For this reason, the Mn content is 4.00% or less. The Mn content may also be 3.30% or less, 3.00% or less, or 2.70% or less.

(P: 0.0200% or Less)

P is an element strongly segregating at the ferrite grain boundaries and prompting embrittlement of the grain boundaries. The P content is preferably as small as possible, therefore ideally is 0%. However, excessive reduction of the P content would invite a major increase in costs, therefore the P content may also be 0.0001% or more and may be 0.0010% or more or 0.0040% or more. On the other hand, if excessively including P, an increase of steel strength and embrittlement of the steel are invited and further sometimes the LME resistance is made to fall. For this reason, the P content is 0.0200% or less. The P content may also be 0.0180% or less, 0.0150% or less, or 0.0100% or less.

(S: 0.0200% or Less)

S is an element forming MnS and other nonmetallic inclusions in the steel and inviting a drop in ductility of steel parts. The S content is preferably as small as possible, therefore ideally is 0%. However, excessive reduction of the S content would invite a major increase in costs, therefore the S content may also be 0.0001% or more and may be 0.0002% or more, 0.0010% or more, or 0.0050% or more. On the other hand, if excessively including S, occurrence of cracks starting from nonmetallic inclusions is invited at the time of cold forming and sometimes the LME resistance is made to fall. For this reason, the S content is 0.0200% or less. The S content may also be 0.0180% or less, 0.0150% or less, or 0.0100% or less.

(Al: 1.000% or Less)

Al is an element acting as a deoxidizer of steel and stabilizing ferrite and may be included in accordance with need. Al need not be included, therefore the lower limit of the Al content is 0%. To sufficiently obtain this effect, the Al content is preferably 0.001% or more and may also be 0.010% or more, 0.050% or more, or 0.100% or more. On the other hand, if excessively including Al, ferrite transformation and bainite transformation are excessively promoted in the cooling process in cold rolled annealing, therefore the strength of the steel sheet sometimes falls. For this reason, the Al content is 1.000% or less. The Al content may also be 0.900% or less, 0.800% or less, or 0.700% or less.

(N: 0.0200% or Less)

N is an element forming coarse nitrides in the steel sheet and causing a drop in the workability of the steel sheet. Further, N is an element becoming a cause of formation of blow holes at the time of welding. The N content is preferably as small as possible, therefore ideally is 0%. However, excessive reduction of the N content would invite a major increase in production costs, therefore the N may be 0.0001% or more and may be 0.0005% or more, 0.0010% or more, or 0.0050% or more. On the other hand, if excessively including N, it will bond with Al or Ti to form large amounts of AlN or TiN. These nitrides make the austenite grain size and block size finer in the cold rolled annealing, therefore sometimes it becomes impossible to control the block size in the steel sheet surface layer to a gradient in the thickness direction. For this reason, the N content is 0.0200% or less. The N content may also be 0.0160% or less, 0.0100% or less, or 0.0080% or less.

The basic chemical composition of the steel sheet in the present embodiment is as explained above. Furthermore, the steel sheet in the present embodiment may contain at least one element among the following optional elements in place of part of the balance of Fe in accordance with need. These elements need not be included, therefore the lower limits are 0%.

(Co: 0 to 0.5000%)

Co is an element effective for control of the morphology of the carbides and increase of strength and may be included for control of the dissolved carbon in accordance with need. To sufficiently obtain these effects, the Co content is preferably 0.0001% or more. The Co content may also be 0.0010% or more, 0.0100% or more, or 0.0400% or more. On the other hand, if excessively including Co, a large amount of fine Co carbides precipitate and these carbides make the austenite grain size and block size finer during the cold rolled annealing, therefore sometimes it becomes impossible to control the block size in the steel sheet surface layer to a gradient in the thickness direction. For this reason, the Co content is preferably 0.5000% or less. The Co content may also be 0.4000% or less, 0.3000% or less, or 0.2000% or less.

(Ni: 0 to 1.0000%)

Ni is a strengthening element and is effective for improvement of the hardenability. In addition, it improves the wettability and promotes an alloying reaction, therefore may be included in accordance with need. To sufficiently obtain these effects, the Ni content is preferably 0.0001% or more. The Ni content may also be 0.0010% or more, 0.0100% or more, or 0.0500% or more. On the other hand, if excessively including Ni, it sometimes has a detrimental effect on the productivity at the time of production and hot rolling and causes deterioration of the hole expandability. For this reason, the Ni content is preferably 1.0000% or less. The Ni content may also be 0.8000% or less, 0.5000% or less, or 0.200% or less.

(Mo: 0 to 1.0000%)

Mo is an element effective for improving the strength of steel sheet. Further, Mo is an element having the effect of inhibiting the ferrite transformation which occurs at the time of heat treatment in continuous annealing facilities or continuous hot dip galvanization facilities. To sufficiently obtain these effects, the Mo content is preferably 0.0001% or more. The Mo content may also be 0.0010% or more, 0.0100% or more, or 0.0500% or more. On the other hand, if excessively including Mo, a large amount of fine Mo carbides precipitates and these carbides make the austenite grain size and block size finer during the cold rolled annealing, therefore sometimes it becomes impossible to control the block size in the steel sheet surface layer to a gradient in the thickness direction. For this reason, the Mo content is preferably 1.0000% or less. The Mo content may also be 0.9000% or less, 0.8000% or less, or 0.700% or less.

(Cr: 0 to 2.0000%)

Cr, like Mn, is an element suppressing pearlite transformation and effective for increasing the strength of steel and may be included as needed. To sufficiently obtain such an effect, the Cr content is preferably 0.0001% or more. The Cr content may also be 0.0010% or more, 0.0100% or more, or 0.0500% or more. On the other hand, if excessively including Cr, it sometimes promotes formation of retained austenite and causes the hole expandability to deteriorate. For this reason, the Cr content is preferably 2.0000% or less. The Cr content may also be 1.8000% or less, 1.6000% or less, or 1.000% or less.

(O: 0 to 0.0200%)

O forms oxides and causes the workability to deteriorate, therefore has to be kept down in content. In particular, oxides are often present as inclusions. If present at the stamped end faces or cut surfaces, they form notch like defects and coarse dimples at the end faces, therefore invite stress concentration at the time of stretch forming and strong working. These become starting points of crack formation and cause a major deterioration of the workability. For this reason, the O content may also be 0%, but excessive reduction invites a major increase in costs and is not economically preferable. For this reason, the O content is preferably 0.0001% or more. The O content may also be 0.0005% or more, 0.0010% or more, or 0.0015% or more. On the other hand, if excessively including O, fracture easily progresses starting from the coarse oxides, therefore sometimes the hole expandability is made to deteriorate. For this reason, the O content is preferably 0.0200% or less. The O content may also be 0.0160% or less, 0.0100% or less, or 0.0050% or less.

(Ti: 0 to 0.500%)

Ti is a strengthening element and contributes to a rise in strength of the steel sheet by precipitation strengthening, fine grain strengthening by inhibiting growth of crystal grains, and dislocation strengthening through inhibiting recrystallization. To sufficiently obtain such an effect, the Ti content is preferably 0.0001% or more. The Ti content may also be 0.001% or more, 0.005% or more, 0.010% or more, or 0.030% or more. On the other hand, if excessively including Ti, coarse carbides precipitate in greater amounts and sometimes the hole expandability deteriorates. For this reason, the Ti content is preferably 0.500% or less. The Ti content may also be 0.400% or less, 0.200% or less, or 0.100% or less.

(B: 0 to 0.0100%)

B is an element suppressing the formation of ferrite and pearlite in the cooling process from austenite and promotes the formation of bainite or martensite and other low temperature transformed structures. Further, B is an element beneficial for increasing the strength of steel and may be included as needed. However, if the B content is too low, sometimes the effect of increasing the strength and other improvements are not sufficiently obtained. Furthermore, identification of less than 0.0001% requires careful attention in analysis. Depending on the analytical apparatus, the lower limit of detection will be reached. For this reason, the B content is preferably 0.0001% or more. The B content may also be 0.0005% or more, 0.0010% or more, or 0.0015% or more. On the other hand, if excessively including B, formation of coarse B oxides in the steel is invited. These become starting points of formation of voids at the time of cold forming, whereby the hole expandability sometimes deteriorates. For this reason, the B content is preferably 0.0100% or less. The B content may also be 0.0080% or less, 0.0060% or less, or 0.0040% or less.

(Nb: 0 to 0.5000%)

Nb is an element effective for control of the morphology of carbides and an element also effective for improving the toughness since its addition refines the structure. To sufficiently obtain these effects, the Nb content is preferably 0.0001% or more. The Nb content may also be 0.0010% or more, 0.0100% or more, or 0.0200% or more. On the other hand, if excessively including Nb, a large number of fine, hard Nb carbides precipitate. These carbides reduce the austenite grain size and block size during the cold rolled annealing, therefore sometimes it becomes impossible to control the block size in the steel sheet surface layer to a gradient in the thickness direction. For this reason, the Nb content is preferably 0.5000% or less. The Nb content may also be 0.4000% or less, 0.2000% or less, or 0.1000% or less.

(V: 0 to 0.5000%)

V is a strengthening element and contributes to a rise in strength of the steel sheet by precipitation strengthening, fine grain strengthening by inhibiting growth of ferrite grains, and dislocation strengthening through inhibiting recrystallization. To sufficiently obtain such an effect, the V content is preferably 0.0001% or more. The V content may also be 0.0010% or more, 0.0100% or more, or 0.0200% or more. On the other hand, if excessively including V, the precipitation of carbonitrides becomes greater and sometimes the hole expandability deteriorates. For this reason, the V content is preferably 0.5000% or less. The V content may also be 0.4000% or less, 0.2000% or less, or 0.1000% or less.

(Cu: 0 to 0.5000%)

Cu is an element effective for improvement of the strength of the steel sheet. To sufficiently obtain such an effect, the Cu content is preferably 0.0001% or more. The Cu content may also be 0.0010% or more, 0.0100% or more, or 0.0200% or more. On the other hand, if excessively including Cu, during the hot rolling, the steel material becomes brittle and sometimes hot rolling becomes impossible. Furthermore, the strength of the steel remarkably rises and sometimes the hole expandability deteriorates. For this reason, the Cu content is preferably 0.5000% or less. The Cu content may also be 0.4000% or less, 0.2000% or less, or 0.1000% or less.

(W: 0 to 0.1000%)

W is effective for raising the strength of the steel sheet and is an extremely important element since precipitates and crystals containing W become hydrogen trapping sites. To sufficiently obtain these effects, the W content is preferably 0.0001% or more. The W content may also be 0.0010% or more, 0.0050% or more, or 0.0100% or more. On the other hand, if excessively including W, formation of voids is promoted at the time of cold working starting from the coarse carbides, therefore sometimes the hole expandability is made to drop. For this reason, the W content is preferably 0.1000% or less. The W content may also be 0.0800% or less, 0.0600% or less, or 0.0400% or less.

(Ta: 0 to 0.1000%)

Ta, like Co, is an element effective for control of the morphology of the carbides and increase of strength and may be included in accordance with need. To sufficiently obtain these effects, the Ta content is preferably 0.0001% or more. The Ta content may also be 0.0010% or more, 0.0050% or more, or 0.0100% or more. On the other hand, if excessively including Ta, a large number of fine Ta carbides precipitate and sometimes the hole expandability is made to drop. For this reason, the Ta content is preferably 0.1000% or less. The Ta content may also be 0.0800% or less, 0.0600% or less, or 0.0400% or less.

(Sn: 0 to 0.0500%)

Sn is an element included in steel when using scrap as a raw material. The less the better. Therefore, the Sn content may also be 0%, but excessive reduction invites an increase in refining costs. For this reason, the Sn content is preferably 0.0001% or more. The Sn content may also be 0.0005% or more, 0.0010% or more, or 0.0020% or more. On the other hand, if excessively including Sn, sometimes a drop in hole expandability is caused due to embrittlement of the steel sheet. For this reason, the Sn content is preferably 0.0500% or less. The Sn content may also be 0.0400% or less, 0.0200% or less, or 0.0100% or less.

(Sb: 0 to 0.0500%)

Sb, like Sn, is an element included when using scrap as a steel raw material. Sb strongly segregates at the grain boundaries and invites embrittlement of the grain boundaries and a drop in ductility, therefore the less the better. 0% is also possible. However, excessive reduction invites an increase in refining costs. For this reason, the Sb content is preferably 0.0001% or more. The Sb content may also be 0.0005% or more, 0.0010% or more, or 0.0020% or more. On the other hand, if excessively including Sb, sometimes a drop in the hole expandability is caused. For this reason, the Sb content is preferably 0.0500% or less. The Sb content may also be 0.0400% or less, 0.0200% or less, or 0.0100% or less.

(As: 0 to 0.0500%)

As, like Sn and Sb, is an element included when using scrap as a steel raw material. It is an element which strongly segregates at the grain boundaries. The less the better. Therefore, the As content may be 0%, but excessive reduction invites an increase in the refining costs. For this reason, the As content is preferably 0.0001% or more. The As content may also be 0.0005% or more, 0.0010% or more, or 0.0020% or more. On the other hand, if excessively including As, a drop in hole expandability is sometimes invited. For this reason, the As content is preferably 0.0500% or less. The As content may also be 0.0400% or less, 0.0300% or less, or 0.0200% or less.

(Mg: 0 to 0.0500%)

Mg is an element enabling control of the morphology of sulfides with trace addition and may be included in accordance with need. To sufficiently obtain such an effect, the Mg content is preferably 0.0001% or more. The Mg content may also be 0.0005% or more, 0.0010% or more, or 0.0020% or more. On the other hand, if excessively including Mg, sometimes a drop in the hole expandability is caused due to the formation of coarse inclusions. For this reason, the Mg content is preferably 0.0500% or less. Mg content may also be 0.0400% or less, 0.0300% or less, or 0.0200% or less.

(Ca: 0 to 0.0500%)

Ca is useful as a deoxidizing element and also has an effect on control of the morphology of sulfides. To sufficiently obtain these effects, the Ca content is preferably 0.0001% or more. The Ca content may also be 0.0005% or more, 0.0010% or more, or 0.0020% or more. On the other hand, if excessively including Ca, sometimes the hole expandability deteriorates. For this reason, the Ca content is preferably 0.0500% or less. The Ca content may also be 0.0400% or less, 0.0300% or less, or 0.0200% or less.

(Y: 0 to 0.0500%)

Y, like Mg and Ca, is an element enabling control of the morphology of sulfides with trace addition and may be included in accordance with need. To sufficiently obtain such an effect, the Y content is preferably 0.0001% or more. The Y content may also be 0.0005% or more, 0.0010% or more, or 0.0020% or more. On the other hand, if excessively including Y, coarse Y oxides are formed and sometimes the hole expandability falls. For this reason, the Y content is preferably 0.0500% or less. The Y content may also be 0.0400% or less, 0.0300% or less, or 0.0200% or less.

(Zr: 0 to 0.0500%)

Zr, like Mg, Ca, and Y, is an element enabling control of the morphology of sulfides with trace addition and may be included in accordance with need. To sufficiently obtain such an effect, the Zr content is preferably 0.0001% or more. The Zr content may also be 0.0005% or more, 0.0010% or more, or 0.0020% or more. On the other hand, if excessively including Zr, coarse Zr oxides are formed and sometimes the hole expandability falls. For this reason, the Zr content is preferably 0.0500% or less. The Zr content may also be 0.0400% or less, 0.0300% or less, or 0.0200% or less.

(La: 0 to 0.0500%)

La is an element enabling control of the morphology of sulfides with trace addition and may be included in accordance with need. To sufficiently obtain such an effect, the La content is preferably 0.0001% or more. The La content may also be 0.0005% or more, 0.0010% or more, or 0.0020% or more. On the other hand, if excessively including La, La oxides are formed and a drop in hole expandability is sometimes invited. For this reason, the La content is preferably 0.0500% or less. The La content may also be 0.0400% or less, 0.0300% or less, or 0.0200% or less.

(Ce: 0 to 0.0500%)

Ce, like La, is an element enabling control of the morphology of sulfides with trace addition and may be included in accordance with need. To sufficiently obtain such an effect, the Ce content is preferably 0.0001% or more. The Ce content may also be 0.0005% or more, 0.0010% or more, or 0.0020% or more. On the other hand, if excessively including Ce, Ce oxides are formed and a drop in hole expandability is sometimes invited. For this reason, the Ce content is preferably 0.0500% or less. The Ce content may also be 0.0400% or less, 0.0300% or less, or 0.0200% or less.

In the steel sheet in the present embodiment, the balance other than the constituents explained above is Fe and impurities. The "impurities" are constituents, etc., entering due to various factors in the producing process, first and foremost the raw materials such as the ores and scraps, etc., when industrially producing the steel sheet according to the present embodiment.

Next, the features of the structure and characteristics of the steel sheet according to an embodiment of the present invention will be explained.

(Total of Ferrite, Pearlite, and Bainite: 0 to 10.0%)

Ferrite, pearlite, and bainite are factors causing a drop in strength of the steel sheet and a drop in hole expandability. The area ratios of the same are preferably as small as possible. Therefore, the total of ferrite, pearlite, and bainite is an area ratio of 10.0% or less and may be 8.0% or less, 6.0% or less, 5.0% or less, or 0%. However, control to 0% makes it necessary to control the integrated production conditions by a high precision and sometimes invites a drop in productivity. For this reason, the total of ferrite, pearlite, and bainite may be an area ratio of 0.3% or more or 0.5% or more.

(Total of Martensite and Tempered Martensite: 80.0 to 100.0%)

Martensite and tempered martensite are structures extremely effective for raising the strength of steel sheet. To secure strength and also hole expandability, the area ratios are preferably as high as possible. Therefore, the total of martensite and tempered martensite is an area ratio of 80.0% or more and may be 85.0% or more, 90.0% or more, 95.0% or more, or 100.0%. However, control to 100.0% makes it necessary to control the integrated production conditions by a high precision and sometimes invites a drop in productivity. For this reason, the total of the martensite and tempered martensite may be an area ratio of 99.5% or less or 99.0% or less.

(Retained Austenite: 0 to 10.0%)

The microstructure of the steel sheet according to an embodiment of the present invention, as explained above, may have area ratios of a total of ferrite, pearlite, and bainite: 0 to 10.0% and of a total of martensite and tempered martensite: 80.0 to 100.0%. It may be comprised of just these and may have balance structures. If there are balance structures, they are preferably comprised of an area ratio of retained austenite: 0 to 10.0%. Retained austenite is a structure effective for improving the strength-ductility balance of the steel sheet, but inclusion in a large amount invites a drop in local ductility and sometimes causes the hole expandability to deteriorate. Therefore, to reliably improve the hole expandability and other characteristics, the area ratio of retained austenite in the microstructure is preferably 10.0% or less and may be 9.0% or less, 8.0% or less, 5.0% or less, 4.0% or less, 3.0% or less, 2.0% or less, 1.0% or less, 0.9% or less, 0.8% or less, 0.6% or less, 0.4% or less, or 0%. However, control to 0% makes it necessary to control the integrated production conditions by a high precision and sometimes invites a drop in productivity. For this reason, the area ratio of the retained austenite in the microstructure may be 0.1% or more or 0.3% or more.

(Block Size at First Depth Region of 1 to 10 μm From Steel Sheet Surface: 5.0 μm or Less)

The block size in a first depth region of 1 to 10 μm from the surface of the steel sheet in the thickness direction is an important factor for raising the hot deformation resistance of steel sheet at the time of spot welding. Here, the first depth region and the later explained second and third depth region mean regions in the cross-sectional structure obtained when cutting the steel sheet in the width direction perpendicular to the rolling direction of the steel sheet and vertical direction with respect to the steel sheet surface. When the steel sheet is rapidly heated at the time of spot welding, the austenite grain size of the hot deforming region, i.e., the region heated by the spot welding, is affected by the block size of the material before welding. That is, the finer the block size of the material, the finer the austenite grain size of the region heated at the time of spot welding. Due to the effect of refinement of the austenite grain size, it becomes possible to suppress an excessive increase in strain at the surface-most layer of the welded material at the time of spot welding. If the block size of the first depth region is large, this effect cannot be obtained and the occurrence of LME at the time of spot welding is invited. For this reason, the block size at the first depth region is 5.0 μm or less, preferably 4.0 μm or less, more preferably 3.0 μm or less. The lower limit value of the block size at the first depth region is not particularly prescribed, but in general is 0.1 μm or more or 0.3 μm or more.

(Block Size at Second Depth Region of 10 to 60 μm From Steel Sheet Surface: 6.0 μm to 20.0 μm)

The block size at a second depth region of 10 to 60 μm from the steel sheet surface is an important factor for suppressing the concentration of strain at the steel sheet surface layer at the time of spot welding. When the block size at the second depth region is sufficiently coarser than the block size at the first depth region, a difference in the strain received at the first depth region and the second depth region arises at the time of hot deformation at the time of spot welding. Specifically, the second depth region receives more strain than the first depth region, therefore the strain occurring at the first depth region can be suppressed. If the block size at the second depth region is not sufficiently larger than the block size of the first depth region, this effect cannot be obtained. As a result, occurrence of LME at the steel sheet at the time of spot welding is invited. For this reason, the block size of the second depth region is 6.0 μm or more and may be 8.0 μm or more or 10.0 μm or more. On the other hand, if the block size at the second depth region is too large, the deformation resistance at the time of spot welding excessively falls. For this reason, if the block size at the second depth region is too large, at the time of spot welding, the amount of deformation at the second depth region remarkably increases and the amount of strain occurring at the first depth region increases causing the occurrence of LME. For this reason, the block size at the second depth region is 20.0 μm or less and is preferably 18.0 μm or less, more preferably 15.0 μm or less.

(Block Size at Third Depth Region of 60 μm to ¼ Thickness From Steel Sheet Surface: Less than 6.0 μm)

The block size at a third depth region of 60 μm to ¼ thickness from the steel sheet surface is an important factor for suppressing the concentration of strain at the steel sheet surface layer at the time of spot welding. To make the strain occurring at the second depth region at the time of spot welding disperse not in the thickness direction, but at the plane parallel to the rolling direction and width direction of the steel sheet, the third depth region has to be made a layer with a block size finer than and with a hardness greater than the second depth region. By having such a constitution, the hot deformation resistance at the third depth region at the time of spot welding becomes higher than the second depth region. By making the block sizes of the first depth region and the third depth region smaller than the block size of the second depth region, the hot deformation resistances at the first depth region and the third depth region become greater than the hot deformation resistance of the second depth region. For this reason, the strain occurring at the time of spot welding occurs concentrated at the second depth region and the occurrence of strain at the first depth region and the third depth region can be suppressed. If the block size at the third depth region is larger than the second depth region, the strain occurring at the second depth region at the time of spot welding also ends up dispersing to the third depth region. For this reason, the strain ends up dispersing in the thickness direction, the effect cannot be obtained, and occurrence of LME at the time of spot welding is invited. For this reason, the block size at the third depth region is less than 6.0 μm, preferably is 5.0 μm or less, more preferably is 3.0 μm or less. The lower limit value of the block size at the third depth region is not particularly prescribed, but in general is 0.1 μm or more or 0.3 μm or more.

(Plating Layer)

The steel sheet according to an embodiment of the present invention may include a plating layer at least at one surface, preferably at both surfaces, for the purpose of improving the corrosion resistance, etc. This plating layer may be a plating layer having any composition known to persons skilled in the art. It is not particularly limited, but, for example, may include zinc, aluminum, magnesium, or an alloy consisting of any combination thereof. Further, the plating layer may be subjected to alloying treatment or need not be subjected to alloying treatment. If performing the alloying treatment, the plating layer may include an alloy of at least one of the above elements and the iron diffused from the steel sheet. Further, the amount of deposition of the plating layer is not particularly limited and may be a general amount of deposition.

(Tensile Strength: TS)

Regarding the tensile strength, for lightening the weight of a structural member using steel as its material and for improving the resistance of the structural member in plastic deformation, the steel material preferably have a large work hardening ability and exhibits its maximum strength, specifically preferably has a tensile strength of 1200 MPa or more. If the tensile strength is low, the effect of lightening the weight of the structural member using steel as its material and improving the deformation resistance becomes smaller. In relation to this, according to steel sheet having the above chemical composition and structure, a tensile strength of 1200 MPa or more can be reliably achieved. The tensile strength of the steel sheet is preferably 1280 MPa or more, more preferably 1350 MPa or more or 1400 MPa or more, most preferably 1500 MPa or more. On the other hand, if the tensile strength is too high, the material easily becomes brittle and fractures during plastic deformation and falls in formability. For this reason, the tensile strength of the steel sheet is generally 2300 MPa or less and may be 2100 MPa or less, 2000 MPa or less, or 1900 MPa or less. The tensile strength is measured by obtaining a JIS No. 5 test piece from a direction in which a longitudinal direction of the test piece becomes parallel to the direction perpendicular to rolling of the steel sheet and performing a tensile test based on JIS Z 2241(2011).

(Total Elongation: t-El)

According to a specific embodiment of the present invention, in addition to a high strength and excellent weldability, improvement of the total elongation is also possible. For example, a total elongation of 5.0% or more, 6.0% or more, or 8.0% or more can be achieved. The upper limit value is not particularly prescribed, but, for example, the total elongation may be 25.0% or less or 20.0% or less. When working the steel sheet material cold to produce a structural member, elongation becomes required for finishing it to a complicated shape. Therefore, steel sheet able to achieve such a high total elongation is extremely useful in producing a structural member. The total elongation is measured by obtaining a JIS No. 5 test piece from a direction in which a longitudinal direction of the test piece becomes parallel to the direction perpendicular to rolling of the steel sheet and performing a tensile test based on JIS Z 2241(2011).

(Hole Expansion Value: λ)

According to a specific embodiment of the present invention, in addition to a high strength and excellent weldability, improvement of the hole expandability is also possible. For example, a hole expansion value of 20.0% or more, 25.0% or more, or 30.0% or more can be achieved. Such a high hole expansion value can be reliably achieved by making the area ratio of the retained austenite in the microstructure 10.0% or less. The upper limit value is not particularly prescribed, but, for example, the hole expansion value may be 90.0% or less or 80.0% or less. When working the steel sheet material cold to produce a structural member, hole expandability becomes required in addition to elongation for finishing it to a complicated shape. Therefore, steel sheet able to realize such a high hole expansion value is extremely useful in producing a structural member. The hole expansion value is determined in the following way. First, a test piece is punched to give a circular hole of a diameter of 10 mm (initial hole: hole diameter d0=10 mm) under conditions giving a clearance of 12.5%. The piece is set so that the burr becomes the die side and the initial hole is expanded by an apex angle 60° conical punch until a crack is formed passing through the sheet thickness. The hole diameter d1 mm at the time of cracking is measured, and the hole expansion value λ (%) of each test piece is found by the following formula. This hole expansion test is performed five times and the average value of these is determined as the hole expansion value λ.

$$\lambda=100\times(d1-d0)/d0$$

(Sheet Thickness)

The thickness of the steel sheet is a factor affecting the rigidity of the steel member after shaping. The greater the thickness, the higher the rigidity of the member. Therefore, from the viewpoint of raising the rigidity, a thickness of 0.2 mm or more is preferable. The thickness may be 0.3 mm or more, 0.6 mm or more, 1.0 mm or more, or 2.0 mm or more. On the other hand, if the thickness is too great, the shaping load at the time of hole expansion increases and sometimes wear of the die or a drop in productivity is invited. For this reason, a thickness of 6.0 mm or less is preferable. The thickness may also be 5.0 mm or less or 4.0 mm or less.

Next, the methods of examination and measurement of the structure prescribed above will be explained.

(Method of Evaluation of Area Ratios of Ferrite, Pearlite, and Bainite)

The structure is observed by a scan electron microscope. Before observation, the sample for observation of the structure is polished by wet polishing by emery paper and by a diamond abrasive having an average particle size of 1 μm to finish the observed surface to a mirror surface, then the structure is etched by a 3% nitric acid alcohol solution. The observation power is made 3000×. 10 fields of 30 μm×40 μm at ¼ positions of thickness from the surface are photographed at random. The ratios of the structures are found by the point count method. In the observed image, a total of 100 lattice points are set arranged at intervals of a vertical 3 μm and horizontal 4 μm, the structures present beneath the lattice points are judged, and the ratios of structures included in the steel material are found from the average of 10 samples. Ferrite is a clump-like crystal grain and does not contain inside it iron-based carbides of long axes of 100 nm or more. Bainite is a collection of lath-like crystal grains and does not contain inside it iron-based carbides of long axes of 20 nm or more or contains inside it iron-based carbides of long axes of 20 nm or more where those carbides belong to single variants, i.e., a group of iron-based carbides extending in the same direction. Here, a "group of iron-based carbides extending in the same direction" means a group of iron-based carbides with differences in direction of extension of within 5°. The bainite is counted using the bainite surrounded by grain boundaries of orientation differences of 15° or more as one bainite grain. Pearlite is a structure including cementite precipitated in lines. Regions captured by a bright contrast in a secondary electron image are deemed pearlite for calculation of the area ratio.

(Method of Evaluation of Area Ratios of Martensite and Tempered Martensite)

For the tempered martensite, a ¼ position of sheet thickness from the surface is observed under scan type and transmission type electron microscopes. Structures containing carbides containing large amounts of Fe inside (Fe-based carbides) are identified as tempered martensite whiles ones not containing almost any carbides are identified as martensite. Fe-based carbides having various crystal structures have been reported, but any of the Fe-based carbides may be contained. Depending on the heat treatment conditions, sometimes a plurality of types of Fe-based carbides will be present.

(Method of Evaluation of Area Ratio of Retained Austenite)

The area ratio of retained austenite is determined by X-ray measurement as follows: First, a portion from the surface of the steel sheet down to the ¼ position of sheet thickness is removed by mechanical polishing and chemical polishing. The chemically polished surface is measured by using MoKα rays as the characteristic X-rays. Further, the area ratio of the retained austenite is calculated using the following formula from the integrated intensity ratio of the diffraction peaks of (200) and (211) of the body centric cubic lattice (bcc) phase and (200), (220), and (311) of the face centric cubic lattice (fcc) phase:

$$S\gamma=(I_{200f}+I_{220f}+I_{311f})/(I_{200b}+I_{211b})\times 100$$

Here, Sγ indicates the area ratio of the retained austenite, $I_{200f}$, $I_{220f}$, and $I_{311f}$ respectively indicate the intensities of the diffraction peaks of (200), (220), and (311) of the fcc phase, and $I_{200b}$ and $I_{211b}$ respectively indicate the intensities of the diffraction peaks of (200) and (211) of the bcc phase.

(Method of Evaluation of Block Sizes in First to Third Depth Regions)

The block size (μm) is found from the crystal orientation map obtained by the FESEM-EBSP method without differentiating between martensite blocks and bainite blocks. Specifically, a surface parallel to the width direction perpendicular to the rolling direction is cut out at the steel sheet surface layer by FIB (focused ion beam) and fields of 30 μm in the rolling direction and 90 μm in the sheet width direction are measured by EBSP at 0.1 μm pitches. The orientations of the αFe are identified from the Kikuchi line pattern obtained by EBSP measurement. The crystal orientation map is found from the αFe orientations. This crystal orientation map is divided in the thickness direction to the three regions of 1 to 10 μm (first depth region), 10 to 60 μm (second depth region), and 60 to 90 μm (third depth region). In the divided crystal orientation map, regions surrounded by differences in orientation with adjoining crystals of 15° or more are identified. A region surrounded with 15° or more differences in orientation is defined as one grain of a block. The circle equivalent diameters are found from the areas of the respective blocks. The average value of the circle equivalent diameters in a field is calculated and defined as the block size.

<Method for Producing Steel Sheet>

The method for producing a steel sheet according to an embodiment of the present invention is characterized by using a material having the above-mentioned ranges of constituents and integrally managing the hot rolling and cold rolling and annealing conditions. Specifically, the method for producing a steel sheet according to an embodiment of the present invention comprises a step of hot rolling a steel slab having the same chemical composition as the chemical composition explained above relating to the steel sheet, then coiling it at 500° C. or more, a step of pickling the obtained hot rolled steel sheet to remove oxide scale present on the surface of the hot rolled steel sheet, wherein an amount of removal of the surface layer of the hot rolled steel sheet is less than 5.00 μm, a step of cold rolling the hot rolled steel sheet by a rolling reduction of 30 to 90%, and an annealing step of holding the obtained cold rolled steel sheet in an atmosphere of a dew point of −20 to 20° C. at a temperature region of 740 to 900° C. for 40 to 300 seconds. Below, these steps will be explained in detail.

(Hot Rolling and Coiling Step)

In this step, a steel slab having the same chemical composition as the chemical composition explained above in relation to the steel sheet is supplied to the hot rolling operation. The steel slab used is preferably cast by a continuous casting method from the viewpoint of productivity, but may also be produced by an ingot making method or thin slab casting method. Further, the cast steel slab may also be optionally roughly rolled before finish rolling so as to adjust the thickness, etc. Such rough rolling need only secure the desired sheet bar dimensions. The conditions are not particularly limited. The hot rolling is not particularly limited, but in general is performed under conditions giving a temperature of completion of finish rolling of 650° C. or more. This is because if the completion temperature of finish rolling is too low, the rolling reaction force will rise and the desired thickness will be difficult to stably obtain. The upper limit is not particularly limited, but in general the completion temperature of finish rolling is 950° C. or less.

(Coiling Temperature)

After the hot rolling, the obtained hot rolled steel sheet is coiled at a coiling temperature of 500° C. or more. The coiling temperature is a factor controlling the state of formation of oxide scale and oxides on the steel sheet surface in hot rolled steel sheet and having an impact on the strength of the hot rolled steel sheet. By coiling at a coiling temperature of 500° C. or more, oxides (internal oxides) are made to form at the surface layer of the hot rolled steel sheet. The oxides can be crushed and made to finely disperse by the subsequent cold rolling. Due to the finely dispersed oxides, it is possible to suppress grain growth at the first depth region of the steel sheet surface layer. For this reason, it becomes possible to create a structure with block sizes controlled to a gradient from the surface layer of thickness toward the center layer of thickness after cold rolled annealing. However, if coiling at a relatively low temperature, it is not possible to cause the formation of sufficient oxides in the thickness direction at the surface layer of the hot rolled steel sheet. For this reason, in the following pickling and cold rolling steps, it becomes no longer possible to promote crushing and fine dispersion of oxides at the steel sheet surface layer and, after cold rolled annealing, it becomes no longer possible to control the former austenite grain size and block size of the steel sheet surface layer to a gradient. For this reason, the coiling temperature is 500° C. or more, preferably 530° C. or more, more preferably more than 550° C. or 560° C. or more. By coiling at a relatively high temperature of more than 550° C., in particular 560° C. or more, it is possible to better promote the formation of internal oxides at the surface layer of the hot rolled steel sheet and make the internal oxides finely disperse by the subsequent cold rolling and in turn remarkably raise the effect of suppression of grain growth at the first depth region. The upper limit of the coiling temperature is not particularly prescribed, but if the coiling temperature is too high, the oxides formed at the surface layer of the hot rolled steel sheet become remarkably coarse. After the following pickling and cold rolling steps, these coarse oxides are not crushed but remain as coarse even after the cold rolled annealing, whereby sometimes a drop in the hole expandability is caused. For this reason, the coiling temperature is preferably 700° C. or less, more preferably 670° C. or less.

(Pickling Step)

The coiled hot rolled steel sheet is uncoiled and supplied for pickling. By pickling, it is possible to remove oxide scale present on the surface of the hot rolled steel sheet and to improve the chemical convertibility or plateability of the cold rolled steel sheet. "Oxide scale" means the layer of oxides formed on the surface of the steel sheet (external oxide layer) and includes fayalite ($Fe_2SiO_4$) of the complex oxide of FeO and $SiO_2$ formed at the interface with steel sheet, etc. In addition, pickling causes promotion of the dissolution of the surface layer of the steel sheet and does not cause dissolution below the oxide scale at the surface layer of the hot rolled steel sheet, i.e., the oxides formed inside the steel sheet (internal oxides), or leaves them completely without causing dissolution and uses cold rolling to crush these undissolved oxides and make them finely disperse, and thereby can give a gradient function to the structure of the steel sheet surface layer after annealing. The pickling may be performed once or may be performed divided into a plurality of times for controlling the amount of dissolution of the steel so as to leave oxides in the steel formed below the oxide scale of the hot rolled steel sheet. Mechanical polishing may also be performed by a grinding brush, etc., before or after the pickling. Further, instead of measuring the change of thickness before and after pickling, it is also possible to find the amount of removal of the steel sheet surface layer from the change of the coil weight before and after pickling. If the amount of removal of the steel sheet surface layer is too great, the amount of crushed oxides present at the steel sheet surface layer after cold rolling will become smaller, therefore the desired distribution of grain size can no longer be obtained at the steel sheet surface layer after cold rolled annealing and the LME resistance is made to fall. For this reason, the amount of removal of the steel sheet surface layer by the pickling is less than 5.00 μm, preferably is 4.00 μm or less or 3.50 μm or less. As explained previously, by making the coiling temperature 500° C. or more to promote the formation of internal oxides while keeping down the amount of removal of the steel sheet surface layer by the subsequent pickling to less than 5.00 μm, i.e., by using the specific combination of a 500° C. or more coiling temperature and amount of removal by pickling of less than 5.00 μm, it is possible to secure a thickness of the internal oxide layer of 1.00 μm or more after pickling and before cold rolling and as a result it becomes possible to finely disperse the internal oxides by cold rolling and in turn reliably obtain the effect of inhibiting grain growth in the first depth region. The thickness of the internal oxide layer secured after pickling and before cold rolling need only be 1.00 μm or more. The upper limit is not particularly prescribed, but, for example, may be 15.00 μm or less. If the thickness of the internal oxide layer is great and the coarse oxides increase, these coarse oxides will not be sufficiently crushed by the cold rolling and will remain coarse even after cold rolled annealing, sometimes causing a drop in the hole expandability. Therefore, from the viewpoint of improving the hole expandability, the thickness of the internal oxide layer after pickling and before cold rolling is preferably 10.00 μm or less. Here, the "thickness of the internal oxide layer" means the distance from the surface of the steel sheet down to the furthest position where internal oxides are present in the case of proceeding from the surface of the steel sheet in the thickness direction of the steel sheet (direction vertical to surface of steel sheet). The lower limit value of the amount of removal of the steel sheet surface layer is not particularly prescribed and may be 0 μm. However, with an amount of removal of less than 0.01 μm, sometimes oxide scale will partially remain at the steel sheet surface. In such a case, a drop in the aesthetic appearance of the surface and/or a drop in the surface smoothness will be caused and a drop in the hole expandability is liable to be caused. For this reason, from the viewpoint of improvement of the hole expandability, etc., the amount of removal of the steel sheet surface layer is preferably 0.01 μm or more. It may also be 0.10 μm or more, 0.20 μm or more, 0.30 μm or more, 0.40 μm or more, 0.50 μm or more, 0.60 μm or more, 0.80 μm or more, or 1.00 μm or more.

(Cold Rolling Step)

Next, the obtained hot rolled steel sheet is cold rolled. The rolling reduction in the cold rolling is an extremely important control factor in steel sheet with oxides remaining at the surface layer for making the oxides finely disperse by being crushed and obtaining the effect of making the block size smaller by the fine dispersion of oxides at the first depth region of 1 to 10 μm from the steel sheet surface after cold rolled annealing. If the rolling reduction is less than 30%, the effect of crushing the oxides is not obtained and it is no longer possible to control the block size in the first depth region to 5.0 μm or less. For this reason, the rolling reduction is 30% or more, preferably 35% or more or 40% or more. On the other hand, if the rolling reduction is more than 90%, the oxide layer formed at the surface layer of the hot rolled steel sheet becomes extremely thin after cold rolling, therefore the desired distribution of grain size can no longer be obtained at the surface layer of steel sheet after cold rolled annealing and the LME resistance is made to fall. For this reason, the rolling reduction is 90% or less, preferably 85% or less or 80% or less. In the method for producing steel sheet according to an embodiment of the present invention, it is important to promote the formation of the internal oxide layer and use relatively weak pickling to mainly remove the external oxide layer and leave the internal oxide layer while making internal oxides finely disperse. In the present method, such fine dispersion of internal oxides is achieved by the specific combination of a 500° C. or more coiling temperature, amount of removal by pickling of less than 5.00 μm, and cold rolling by a 30 to 90% rolling reduction. The fine dispersion of internal oxides and furthermore the effect of inhibiting grain growth at the first depth region based on such a specific combination of production conditions were not known in the past and were first clarified by the inventors this time.

To better promote the fine dispersion of oxides of the steel sheet surface layer in the cold rolling step, in the cold rolling, it is preferable to impart a larger shear deformation to the steel sheet surface layer. To impart a larger shear deformation to the steel sheet surface layer, for example, the cold rolling step desirably includes supplying lubrication oil with a coefficient of friction of less than 0.10 between the steel sheet and rolling rolls while rolling by a rolling load of 800 ton/m or more. In a continuous cold rolling machine comprised of multiple stages of rolling stands, it is sufficient that in at least one rolling stage, the rolling be performed with a coefficient of friction of less than 0.10 and a rolling load of 800 ton/m or more. Further, if performing the rolling divided into several operations, among these rolling operations, it is sufficient that in at least one rolling operation, the rolling be performed with a coefficient of friction of less than 0.10 and a rolling load of 800 ton/m or more. In the case of a coefficient of friction of 0.10 or more or a rolling load of less than 800 ton/m, the amount of shear deformation becomes relatively small and sometimes it is not possible to sufficiently promote fine dispersion of oxides at the steel sheet surface layer. Further, the smaller the coefficient of friction and/or the higher the rolling load, the greater the amount of shear deformation given to the steel sheet surface layer becomes. For this reason, the coefficient of friction is preferably 0.08 or less and may be 0.06 or less, 0.04 or less or 0.02 or less. The lower limit of the coefficient of friction is not particularly prescribed, but, for example, the coefficient of friction may be 0.01 or more. In addition, the rolling load may be 1000 ton/m or more, 1200 ton/m or more, 1300 ton/m or more, 1400 ton/m or more, or 1600 ton/m or more. The upper limit of the rolling load is not particularly prescribed, but, for example, the rolling load may be 2000 ton/m or less.

(Annealing Step)

Finally, the obtained cold rolled steel sheet is annealed under predetermined conditions (also referred to as "cold rolled annealing") whereby steel sheet according to an embodiment of the present invention is obtained. Below, this cold rolled annealing will be explained in detail.

(Dew Point at Temperature Region of 740 to 900° C.)

By controlling the dew point at 740 to 900° C. in cold rolled annealing, it becomes possible to promote decarburization in a second depth region of 10 to 60 μm from the steel sheet surface and thereby make the mobility of the grain boundaries of the austenite increase and make the block size at that second depth region coarser. If the dew point is too low, the amount of decarburization at the second depth region becomes insufficient, the mobility of the grain boundaries of the austenite does not increase, and coarsening of the austenite grain size and block size in the second depth region is obstructed. For this reason, the lower limit of the dew point is −20° C. or more, preferably −15° C. or more. On the other hand, if the dew point is high, the amount of decarburization in the second depth region becomes excessive and the mobility of the grain boundaries of the austenite remarkably increases, therefore the austenite grain size and block size in the second depth region remarkably coarsen. For this reason, the upper limit of the dew point is 20° C. or less, preferably 15° C. or less.

(Holding Time in Temperature Region of 740 to 900° C.)

By controlling the holding time at the temperature region of 740 to 900° C. in cold rolled annealing, it becomes possible to promote decarburization in the second depth region and thereby make the mobility of the grain boundaries of the austenite increase and make the austenite grain size and block size at that second depth region coarser. Here, the "holding time" means the time when dwelling in the temperature region of 740 to 900° C. and accordingly encompasses the time in the case where the temperature is gradually raised between 740 to 900° C. If the holding time is short, the amount of decarburization at the second depth region becomes insufficient, the mobility of the grain boundaries of the austenite does not increase, and coarsening of the austenite grain size and block size at the second depth region is inhibited. For this reason, the lower limit of the holding time is 40 seconds, preferably 60 seconds or more. On the other hand, if the holding time is long, the amount of decarburization at the second depth region becomes excessive and the mobility of grain boundaries of the austenite remarkably increases, therefore the austenite grain size and block size at the second depth region remarkably coarsen. For this reason, the upper limit of the holding time is 300 seconds or less, preferably 250 seconds or less.

(Average Cooling Rate)

Below, a preferred embodiment of the cooling after annealing, tempering, and plating will be explained in detail. The following descriptions are just illustrations of preferred embodiment of the cooling after annealing, tempering, and plating and do not limit the method for producing steel sheet in any way. The cooling after annealing is preferably performed from 750° C. to 550° C. by an average cooling rate 100° C./s or less. By cooling by a 100° C./s or less average cooling rate, variations in hardness can be suppressed. The average cooling rate may be 80° C./s or less or 50° C./s or less. The lower limit value of the average cooling rate is not particularly prescribed, but from the viewpoint of securing sufficient strength, for example, may be 2.5° C./s, preferably is 5° C./s or more, more preferably 10° C./s or more, most preferably 20° C./s or more.

(Cooling Stop Temperature)

The above cooling is stopped at a temperature of 25 to 550° C. (cooling stop temperature), then, if this cooling stop temperature is lower than a plating bath temperature, the sheet may be reheated to and made to dwell at a temperature region of 350 to 550° C. If cooling in the above-mentioned temperature range, martensite is produced from the untransformed austenite during cooling. After that, by reheating, the martensite is tempered whereby carbides precipitate in the hard phases and dislocations are reversed or realigned and the hydrogen embrittlement resistance is improved.

(Dwell Temperature and Dwell Time)

The steel sheet may be made to dwell at a temperature region of 350 to 550° C. after reheating and before dipping in the plating bath. Dwelling at this temperature region not only contributes to tempering of the martensite, but also eliminates uneven temperature in the width direction of the sheet and improves the appearance after plating. If the cooling stop temperature is 350 to 550° C., it is sufficient to perform the dwell operation without reheating. If performing the dwell operation, the dwell time is preferably 10 to 600 seconds.

(Tempering)

Tempering may be performed by starting reheating after cooling the cold rolled sheet, or steel sheet obtained by plating the cold rolled sheet, down to room temperature in the series of annealing step or in the middle of cooling it down to room temperature (however, the martensite transformation start temperature (Ms) or less) and holding it at the 150 to 400° C. temperature region for 2 seconds or more. According to such treatment, it is possible to temper the martensite formed during the cooling after reheating to obtain tempered martensite and thereby improve the hydrogen embrittlement resistance. The tempering may be performed in the continuous annealing facility or may be performed off line by a separate facility after the continuous annealing. At this time, the tempering time differs depending on the tempering temperature. That is, the lower the temperature, the longer the time and the higher the temperature, the shorter the time.

(Plating)

The cold rolled steel sheet during the annealing step or after the annealing step may, as necessary, be heated to (galvanizing bath temperature−40)° C. to (galvanizing bath temperature+50)° C., or cooled to there, and be hot dip galvanized. Due to the hot dip galvanization step, at least one surface, preferably both surfaces, of the cold rolled steel sheet are formed with a hot dip galvanized layer. In this case, the corrosion resistance of the cold rolled steel sheet is improved, therefore this is preferable. Even if performing hot dip galvanization, the LME resistance of the cold rolled steel sheet can be sufficiently maintained.

(Hot Dip Coating Bath Sheet Temperature)

The hot dip coating bath sheet temperature (temperature of steel sheet when dipped in hot dip galvanizing bath) is preferably a temperature range from a temperature 40° C. lower than the hot dip galvanizing bath temperature (hot dip galvanizing bath temperature−40° C.) to a temperature 50° C. higher than the hot dip galvanizing bath temperature (hot dip galvanizing bath temperature+50° C.). If the hot dip coating bath sheet temperature is lower than the hot dip galvanizing bath temperature−40° C., the heat removal at the time of dipping in the plating bath is large and part of the molten zinc will end up solidifying, sometimes causing the appearance to worsen, therefore this is not preferable. If the sheet temperature before dipping is lower than the hot dip galvanizing bath temperature−40° C., any method may be used to further heat the sheet before dipping it in the plating bath to control the sheet temperature to the hot dip galvanizing bath temperature−40° C. or more and then dip the sheet in the plating bath. Further, if the hot dip coating bath sheet temperature is more than the hot dip galvanizing bath temperature+50° C., problems are caused in operation along with the rise in the plating bath temperature.

(Composition of Plating Bath)

The plating bath preferably is mainly comprised of Zn and has an effective amount of Al (value of total amount of Al in plating bath minus total amount of Fe) of 0.050 to 0.250 mass %. If the effective amount of Al in the plating bath is less than 0.050 mass %, the infiltration of Fe into the plating layer excessively proceeds and the plating adhesion is liable to drop. On the other hand, if the effective amount of Al in the plating bath is more than 0.250 mass %, Al-based oxides obstructing movement of Fe atoms and Zn atoms are formed at the boundary of the steel sheet and the plating layer and the plating adhesion is liable to fall. The effective amount of Al in the plating bath is more preferably 0.065 mass % or more and more preferably 0.180 mass % or less. The plating bath may also contain Mg or other elements in addition to Zn and Al.

(Holding Temperature After Dipping in Plating Bath)

If treating the hot dip galvanized layer to alloy it, the steel sheet formed with the hot dip galvanized layer is preferably heated to a temperature range of 470 to 550° C. If the alloying temperature is less than 470° C., the alloying is liable to not sufficiently proceed. On the other hand, if the alloying temperature is more than 550° C., the alloying proceeds too much and F phases are formed whereby the concentration of Fe in the plating layer becomes more than 15% and the corrosion resistance is liable to deteriorate. The alloying temperature is more preferably 480° C. or more and more preferably 540° C. or less. The alloying temperature has to be changed in accordance with the chemical composition of the steel sheet and the degree of formation of the internal oxide layer, therefore should be set while confirming the concentration of Fe in the plating layer. On the other hand, if not treating the hot dip galvanized layer to alloy it, the holding temperature after dipping in the plating bath may be less than 470° C., for example, may be 450 to less than 470° C.

(Plating Pretreatment)

To further improve the plating adhesion, before the annealing at the continuous hot dip galvanizing line, the base material steel sheet may be plated with one or more of Ni, Cu, Co, and Fe.

(Plating Post Treatment)

The surface of the hot dip galvanized steel sheet and hot dip galvannealed steel sheet can be given a top plating or treated in various ways, for example, by chromate treatment, phosphate treatment, lubrication improving treatment, weldability improving treatment, etc., for the purpose of improving the coatability and weldability.

(Skin Pass Rolling Reduction)

Furthermore, skin pass rolling may be performed for the purpose of correcting the shape of the steel sheet or introducing movable dislocations so as to improve the ductility. The rolling reduction in skin pass rolling after heat treatment is preferably 0.1 to 1.5% in range. If less than 0.1%, the effect is small and control is also difficult, therefore 0.1% is the lower limit. If more than 1.5%, the productivity remarkably falls, therefore 1.5% is the upper limit. The skin pass may be performed in line or may be performed off line. Further, skin pass of that rolling reduction may be performed at one time or may be performed divided into several operations.

According to the above-mentioned method of production, it is possible to obtain the steel sheet according to an embodiment of the present invention.

Below, examples according to the present invention will be shown. The present invention is not limited to these illustrations of conditions. The present invention can make use of various conditions so long as not departing from the gist of the present invention and achieving the object of the present invention.

EXAMPLES

Example 1

Steels having various chemical compositions were made to produce steel slabs. Each of these steel slabs was inserted to a furnace heated to 1220° C. and held there for 60 minutes for homogenization treatment, then was taken out into the atmosphere and hot rolled to obtain a thickness 2.6 mm steel sheet. The end temperature of the finish rolling in the hot rolling was 890° C. The sheet was cooled down to 540° C. and coiled. Next, the oxide scale of the hot rolled steel sheet was removed by pickling to remove a thickness of 3.0 μm per side from the surface layers of the two surfaces of the steel sheet (thickness of internal oxide layer after pickling and before cold rolling as shown in Tables 2), cold rolling by a rolling reduction of 50%, and finishing the sheet to a thickness of 1.4 mm. The rolling load of the rolling machine applying the highest rolling load in the cold rolling and the coefficient of friction of the lubrication oil used in that rolling machine are shown in Tables 2. Furthermore, this cold rolled steel sheet was annealed. Specifically, when raising the temperature to 880° C., the atmosphere was controlled to a dew point of 8° C. in the temperature range of 740 to 900° C. The holding time at that temperature range was 130 seconds. Next, the cold rolled steel sheet was cooled and made to dwell under the conditions shown in Tables 2, then was rolled by a skin pass. The chemical compositions obtained by analyzing samples taken from the obtained steel sheets were as shown in Tables 1. The balances other than the constituents shown in Tables 1 consisted of Fe and impurities. Further, Tables 2 show the results of evaluation of the characteristics of the steel sheets given the above thermomechanical treatment.

(Evaluation of Tensile Strength, Total Elongation, and Hole Expansion Value)

The tensile strength (TS) and total elongation (t-El) were measured by obtaining a JIS No. 5 test piece from a direction in which a longitudinal direction of the test piece became parallel to the direction perpendicular to rolling of the steel sheet and performing a tensile test based on JIS Z 2241 (2011). Further, the hole expansion value was determined in the following way. First, a test piece was punched to give a circular hole of a diameter of 10 mm (initial hole: hole diameter d0=10 mm) under conditions giving a clearance of 12.5%. The piece was set so that the burr became the die side and the initial hole was expanded by an apex angle 60° conical punch until a crack was formed passing through the sheet thickness. The hole diameter d1 mm at the time of cracking was measured, and the hole expansion value λ (%) of each test piece was found by the following formula. This hole expansion test was performed five times and the average value of these was determined as the hole expansion value λ.

$$\lambda=100\times(d1-d0)/d0$$

(Evaluation of LME Resistance)

The LME resistance was evaluated in the following way. A welding test was performed between GA soft steel (hot dip galvannealed steel sheet) and each steel sheet shown in Tables 2 under the following conditions: A test piece welded while changing the current from 4.0 kA to 10.0 kA was prepared. After that, the cross-sectional structure was examined to confirm the nugget sizes and crack lengths. A case where the crack length in a region of a nugget size of 5.5 mm or less was less than 0.10 mm was deemed passing while a case where the crack length in a region of a nugget size of 5.5 mm or less was 0.10 mm or more was deemed as failing (NG). Further, among the passing cases, a case where the crack length was 0.03 mm or less was judged as "A", a case where the crack length was more than 0.03 mm and 0.06 mm or less was judged as "B", and a case where the crack length was more than 0.06 mm and less than 0.10 mm was judged as "C".

Electrodes: Cr—Cu DR type electrodes (tip outside diameters: 8 mm, R: 40 mm)
Applied pressure P: 450 kg
Slant angle θ of electrodes: 5°
Upslope: None
First current application time t1: 0.2 second
Non-current application time tc: 0.04 second
Second current application time t2: 0.4 second
Current ratio I1/I2: 0.7
Holding time after end of current application: 0.1 second Cases where the tensile strength was 1200 MPa or more and the LME resistance was evaluated as OK were evaluated as steel sheets high in strength and excellent in weldability.

TABLE 1

| | Chemical composition (mass %, balance: Fe and impurities) | | | | | | | | | | | | | | |
|---|---|---|---|---|---|---|---|---|---|---|---|---|---|---|---|
| No. | C | Si | Mn | P | S | Al | N | Co | Ni | Mo | Cr | O | Ti | B | Nb |
| A | 0.32 | 0.22 | 2.78 | 0.0029 | 0.0014 | 0.023 | 0.0085 | — | — | — | — | — | — | — | — |
| B | 0.29 | 0.25 | 1.84 | 0.0190 | 0.0038 | 0.078 | 0.0021 | — | — | — | — | — | — | — | — |
| C | 0.32 | 0.08 | 1.93 | 0.0004 | 0.0052 | 0.018 | 0.0172 | — | — | — | — | — | — | — | — |
| D | 0.39 | 0.49 | 2.07 | 0.0099 | 0.0018 | 0.842 | 0.0159 | — | — | — | — | — | — | — | — |
| E | 0.34 | 0.68 | 2.33 | 0.0079 | 0.0026 | 0.530 | 0.0005 | — | — | — | — | — | — | — | — |
| F | 0.23 | 0.41 | 2.14 | 0.0059 | 0.0111 | 0.030 | 0.0037 | — | — | — | — | — | — | — | — |
| G | 0.28 | 0.21 | 2.55 | 0.0178 | 0.0121 | 0.416 | 0.0133 | — | — | — | — | — | — | — | — |
| H | 0.32 | 0.89 | 1.47 | 0.0175 | 0.0162 | 0.034 | 0.0062 | — | — | — | — | — | — | — | — |
| I | 0.31 | 0.28 | 2.37 | 0.0120 | 0.0071 | 0.140 | 0.0093 | — | — | — | — | — | — | — | — |
| J | 0.22 | 0.36 | 2.14 | 0.0014 | 0.0159 | 0.235 | 0.0198 | — | — | — | — | — | — | 0.0018 | — |
| K | 0.37 | 0.52 | 3.53 | 0.0105 | 0.0060 | 0.937 | 0.0029 | 0.0248 | 0.0651 | — | 0.1057 | 0.0019 | — | 0.0007 | 0.0519 |
| L | 0.35 | 0.94 | 3.06 | 0.0151 | 0.0085 | 0.603 | 0.0079 | — | — | 0.0515 | — | 0.0094 | 0.035 | — | — |
| M | 0.39 | 0.12 | 1.31 | 0.0065 | 0.0185 | 0.342 | 0.0152 | — | 0.3082 | — | 0.1103 | — | — | — | 0.0556 |
| N | 0.21 | 0.92 | 0.55 | 0.0111 | 0.0007 | 0.036 | 0.0114 | 0.0628 | — | — | 1.7462 | 0.0014 | — | — | 0.0462 |
| O | 0.25 | 0.61 | 2.80 | 0.0130 | 0.0177 | 0.735 | 0.0122 | 0.0389 | 0.6696 | 0.1658 | — | 0.0020 | 0.046 | 0.0007 | 0.0338 |
| P | 0.36 | 0.07 | 3.73 | 0.0038 | 0.0107 | 0.685 | 0.0062 | — | — | — | — | — | 0.036 | 0.0014 | — |
| Q | 0.27 | 0.57 | 1.79 | 0.0043 | 0.0065 | 0.070 | 0.0051 | — | 0.1727 | — | — | — | — | — | — |
| R | 0.28 | 0.81 | 1.72 | 0.0166 | 0.0091 | 0.014 | 0.0139 | — | — | — | — | — | — | 0.0016 | — |
| S | 0.35 | 0.25 | 1.12 | 0.0109 | 0.0031 | 0.022 | 0.0038 | — | — | — | 0.6182 | 0.0011 | — | — | — |
| T | 0.29 | 0.38 | 2.94 | 0.0086 | 0.0190 | 0.372 | 0.0109 | — | — | 0.0715 | — | 0.0020 | — | 0.0010 | 0.2255 |
| U | 0.18 | 0.37 | 2.74 | 0.0127 | 0.0024 | 0.606 | 0.0141 | — | — | — | — | — | — | — | — |
| V | 0.42 | 0.52 | 1.30 | 0.0007 | 0.0078 | 0.328 | 0.0036 | — | — | — | — | — | — | — | — |
| W | 0.36 | 1.04 | 2.53 | 0.0124 | 0.0093 | 0.480 | 0.0181 | — | — | — | — | — | — | — | — |
| X | 0.38 | 0.89 | 0.06 | 0.0109 | 0.0098 | 0.868 | 0.0166 | — | — | — | — | — | — | — | — |
| Y | 0.26 | 0.17 | 4.13 | 0.0190 | 0.0172 | 0.603 | 0.0032 | — | — | — | — | — | — | — | — |
| Z | 0.25 | 0.74 | 2.16 | 0.0205 | 0.0070 | 0.589 | 0.0074 | — | — | — | — | — | — | — | — |
| AA | 0.23 | 0.20 | 2.09 | 0.0152 | 0.0205 | 0.567 | 0.0036 | — | — | — | — | — | — | — | — |
| AB | 0.39 | 0.10 | 2.98 | 0.0010 | 0.0183 | 1.034 | 0.0025 | — | — | — | — | — | — | — | — |
| AC | 0.26 | 0.25 | 2.52 | 0.0173 | 0.0017 | 0.084 | 0.0206 | — | — | — | — | — | — | — | — |
| AD | 0.30 | 0.95 | 1.66 | 0.0041 | 0.0029 | 0.239 | 0.0085 | 0.0304 | 1.0374 | — | — | — | — | 0.0037 | 0.0518 |
| AE | 0.28 | 0.63 | 0.57 | 0.0180 | 0.0108 | 0.482 | 0.0004 | — | — | — | 2.0557 | 0.0132 | — | 0.0009 | 0.0425 |
| AF | 0.31 | 0.84 | 2.16 | 0.0107 | 0.0039 | 0.256 | 0.0145 | 0.0346 | 0.3840 | 0.0652 | — | 0.0208 | 0.027 | — | — |
| AG | 0.29 | 0.15 | 1.78 | 0.0104 | 0.0042 | 0.367 | 0.0110 | — | — | — | 0.1624 | — | 0.514 | 0.0011 | — |
| AH | 0.37 | 0.73 | 3.81 | 0.0075 | 0.0010 | 0.691 | 0.0064 | — | — | — | — | 0.0018 | — | 0.0104 | 0.0316 |
| AI | 0.36 | 0.88 | 2.89 | 0.0168 | 0.0136 | 0.043 | 0.0050 | 0.0533 | — | 0.0723 | 0.2295 | 0.0151 | — | 0.0073 | 0.0334 |

TABLE 1-continued

| | Chemical composition (mass %, balance: Fe and impurities) | | | | | | | | | | | | | | |
|---|---|---|---|---|---|---|---|---|---|---|---|---|---|---|---|
| AJ | 0.25 | 0.66 | 2.98 | 0.0143 | 0.0164 | 0.178 | 0.0192 | — | — | — | — | — | 0.098 | — | — |
| AK | 0.31 | 0.62 | 1.19 | 0.0184 | 0.0106 | 0.427 | 0.0186 | — | 0.0472 | 0.1144 | 0.2221 | — | 0.054 | 0.0079 | 0.0338 |
| AL | 0.32 | 0.68 | 3.23 | 0.0132 | 0.0062 | 0.119 | 0.0175 | — | — | 0.0551 | — | 0.0012 | — | 0.0019 | — |
| AM | 0.34 | 0.80 | 2.37 | 0.0157 | 0.0091 | 0.673 | 0.0095 | 0.1100 | — | — | 0.1309 | — | 0.069 | — | 0.0446 |
| AN | 0.34 | 0.19 | 3.26 | 0.0127 | 0.0029 | 0.835 | 0.0091 | — | — | 0.0936 | — | 0.0155 | — | 0.0011 | 0.0287 |
| AO | 0.22 | 0.30 | 2.22 | 0.0028 | 0.0173 | 0.722 | 0.0024 | 0.0425 | — | — | 1.4156 | — | 0.042 | — | — |
| AP | 0.39 | 0.52 | 3.30 | 0.0157 | 0.0178 | 0.707 | 0.0152 | — | 0.1012 | 0.0541 | — | 0.0015 | — | 0.0006 | 0.0496 |
| AQ | 0.23 | 0.39 | 2.66 | 0.0172 | 0.0084 | 0.099 | 0.0177 | — | — | 0.0870 | 0.8871 | — | 0.034 | 0.0006 | 0.1079 |
| AR | 0.31 | 0.88 | 3.55 | 0.0076 | 0.0021 | 0.382 | 0.0110 | 0.4196 | — | 0.8216 | — | 0.0020 | — | — | — |
| AS | 0.22 | 0.66 | 1.81 | 0.0093 | 0.0080 | 0.260 | 0.0015 | — | 0.1399 | — | 0.0915 | — | — | 0.0006 | — |
| AT | 0.20 | 0.42 | 1.87 | 0.0067 | 0.0048 | 0.117 | 0.0025 | 0.0328 | — | 0.4306 | — | 0.0017 | — | — | — |
| AU | 0.35 | 0.21 | 1.14 | 0.0047 | 0.0189 | 0.135 | 0.0087 | — | 0.1686 | — | 0.6402 | — | — | — | — |

| No. | V | Cu | W | Ta | Sn | Sb | As | Mg | Ca | Y | Zr | La | Ce |
|---|---|---|---|---|---|---|---|---|---|---|---|---|---|
| A | — | — | — | — | — | — | — | — | — | — | — | — | — |
| B | — | — | — | — | — | — | — | — | — | — | — | — | — |
| C | — | — | — | — | — | — | — | — | — | — | — | — | — |
| D | — | — | — | — | — | — | — | — | — | — | — | — | — |
| E | — | — | — | — | — | — | — | — | — | — | — | — | — |
| F | — | — | — | — | — | — | — | — | — | — | — | — | — |
| G | — | — | — | — | — | — | — | — | — | — | — | — | — |
| H | — | — | — | — | — | — | — | — | — | — | — | — | — |
| I | — | — | — | — | — | — | — | — | — | — | — | — | — |
| J | — | — | — | — | — | — | — | — | — | — | — | — | — |
| K | 0.3823 | — | 0.0069 | 0.0105 | — | 0.0145 | 0.0049 | — | 0.0043 | 0.0382 | 0.0043 | 0.0041 | 0.0108 |
| L | — | 0.0265 | — | — | — | — | — | 0.0057 | — | — | — | — | — |
| M | 0.0392 | — | 0.0760 | — | 0.0063 | 0.0062 | 0.0031 | — | — | — | — | — | — |
| N | 0.0484 | 0.1499 | 0.0048 | 0.0087 | — | — | — | 0.0427 | — | 0.0242 | — | — | — |
| O | — | — | — | — | 0.0338 | — | — | — | 0.0058 | — | — | 0.0131 | — |
| P | — | — | — | — | — | — | — | — | — | — | — | — | — |
| Q | — | 0.0816 | — | — | 0.0020 | — | — | — | — | — | — | — | 0.0028 |
| R | — | — | — | — | — | — | — | — | — | — | 0.0140 | — | — |
| S | — | — | — | — | — | — | — | — | — | — | — | — | — |
| T | — | — | — | — | — | — | 0.0143 | — | 0.0051 | — | — | — | — |
| U | — | — | — | — | — | — | — | — | — | — | — | — | — |
| V | — | — | — | — | — | — | — | — | — | — | — | — | — |
| W | — | — | — | — | — | — | — | — | — | — | — | — | — |
| X | — | — | — | — | — | — | — | — | — | — | — | — | — |
| Y | — | — | — | — | — | — | — | — | — | — | — | — | — |
| Z | — | — | — | — | — | — | — | — | — | — | — | — | — |
| AA | — | — | — | — | — | — | — | — | — | — | — | — | — |
| AB | — | — | — | — | — | — | — | — | — | — | — | — | — |
| AC | — | — | — | — | — | — | — | — | — | — | — | — | — |
| AD | — | 0.0468 | — | 0.0092 | 0.0055 | 0.0030 | 0.0020 | 0.0388 | — | — | — | 0.0050 | — |
| AE | — | 0.0247 | 0.0840 | 0.0064 | — | 0.0043 | — | 0.0024 | — | 0.0168 | — | 0.0039 | — |
| AF | 0.0495 | 0.0480 | 0.0063 | 0.0084 | 0.0347 | — | 0.0047 | 0.0049 | 0.0178 | — | 0.0068 | 0.0029 | 0.0041 |
| AG | — | 0.0339 | — | — | 0.0049 | 0.0395 | — | — | — | 0.0042 | — | 0.0059 | — |
| AH | — | — | 0.0829 | 0.0101 | — | 0.0053 | 0.0413 | 0.0060 | 0.0043 | 0.0062 | 0.0049 | — | 0.0372 |
| AI | 0.5133 | 0.2486 | 0.0065 | — | 0.0170 | 0.0032 | — | — | — | 0.0050 | — | 0.0066 | — |
| AJ | — | 0.5158 | 0.0118 | 0.0084 | 0.0022 | — | — | 0.0432 | 0.0033 | 0.0369 | — | — | 0.0324 |
| AK | 0.0492 | — | 0.1038 | 0.0820 | — | 0.0371 | 0.0414 | — | — | 0.0026 | — | 0.0043 | 0.0160 |
| AL | 0.2935 | 0.0484 | — | 0.1040 | 0.0301 | 0.0040 | — | 0.0031 | — | — | — | — | — |
| AM | 0.0363 | 0.4181 | — | — | 0.0512 | — | 0.0055 | 0.0265 | — | 0.0054 | 0.0420 | 0.0031 | 0.0049 |
| AN | — | — | 0.0151 | 0.0054 | 0.0056 | 0.0513 | — | 0.0053 | 0.0059 | 0.0027 | 0.0056 | — | 0.0050 |
| AO | 0.3796 | 0.0418 | 0.0703 | — | — | 0.0042 | 0.0518 | — | 0.0047 | — | — | 0.0040 | — |
| AP | 0.1107 | — | — | 0.0047 | 0.0030 | — | 0.0225 | 0.0516 | — | 0.0041 | 0.0383 | — | 0.0092 |
| AQ | — | — | — | — | 0.0062 | — | — | 0.0055 | 0.0510 | 0.0379 | — | 0.0035 | 0.0075 |
| AR | 0.0431 | 0.0387 | 0.0123 | 0.0168 | 0.0131 | — | 0.0091 | — | 0.0048 | 0.0514 | 0.0042 | — | — |
| AS | 0.3907 | — | 0.0757 | 0.0153 | 0.0382 | — | — | — | 0.0357 | — | 0.0510 | 0.0218 | — |
| AT | 0.0357 | 0.0353 | 0.0100 | — | — | 0.0070 | 0.0070 | — | — | 0.0025 | — | 0.0519 | 0.0028 |
| AU | — | 0.0260 | — | — | 0.0069 | — | — | 0.0049 | — | 0.0024 | — | — | 0.0518 |

Underlines indicate outside scope of present invention.

TABLE 2

| No. | Finish rolling completion temp. (° C.) | Coiling temp. (° C.) | Am't of removal of steel sheet surface layer (μm) | Thickness of internal oxide layer before cold rolling (μm) | Cold rolling reduction (%) | Cold rolling: Coefficient of friction of lubrication oil | Cold rolling: Rolling load ton/m | Cold rolled annealing: 740 to 900° C. Dew point | Cold rolled annealing: 740 to 900° C. Holding time | Cold rolled annealing: Average cooling rate from 750° C. to 550° C. (° C./s) | Cold rolled annealing: Cooling stop temp. (° C.) | Cold rolled annealing: Dwell temp. (° C.) | Cold rolled annealing: Dwell time (s) | Cold rolled annealing: Tempering (° C.) | Plating | Skin pass rolling reduction (%) |
|---|---|---|---|---|---|---|---|---|---|---|---|---|---|---|---|---|
| A-1 | 890 | 540 | 3.0 | 4.15 | 50 | 0.03 | 892 | 8 | 130 | 45 | 150 | 220 | 140 | No | No | 0.2 |
| B-1 | 890 | 540 | 3.0 | 4.94 | 50 | 0.03 | 927 | 8 | 130 | 45 | 150 | 220 | 140 | No | No | 0.2 |
| C-1 | 890 | 540 | 3.0 | 3.41 | 50 | 0.03 | 983 | 8 | 130 | 45 | 150 | 220 | 140 | No | No | 0.2 |
| D-1 | 890 | 540 | 3.0 | 4.12 | 50 | 0.03 | 1058 | 8 | 130 | 45 | 150 | 220 | 140 | No | No | 0.2 |
| E-1 | 890 | 540 | 3.0 | 3.94 | 50 | 0.03 | 1003 | 8 | 130 | 45 | 150 | 220 | 140 | No | No | 0.2 |
| F-1 | 890 | 540 | 3.0 | 5.46 | 50 | 0.03 | 901 | 8 | 130 | 45 | 150 | 220 | 140 | No | No | 0.2 |
| G-1 | 890 | 540 | 3.0 | 5.46 | 50 | 0.03 | 945 | 8 | 130 | 45 | 150 | 220 | 140 | No | No | 0.2 |
| H-1 | 890 | 540 | 3.0 | 4.00 | 50 | 0.03 | 983 | 8 | 130 | 45 | 150 | 220 | 140 | No | No | 0.2 |
| I-1 | 890 | 540 | 3.0 | 3.37 | 50 | 0.03 | 972 | 8 | 130 | 45 | 150 | 220 | 140 | No | No | 0.2 |
| J-1 | 890 | 540 | 3.0 | 4.81 | 50 | 0.03 | 892 | 8 | 130 | 45 | 150 | 220 | 140 | No | No | 0.2 |
| K-1 | 890 | 540 | 3.0 | 4.14 | 50 | 0.03 | 1034 | 8 | 130 | 45 | 150 | 220 | 140 | No | No | 0.2 |
| L-1 | 890 | 540 | 3.0 | 4.60 | 50 | 0.03 | 1003 | 8 | 130 | 45 | 150 | 220 | 140 | No | No | 0.2 |
| M-1 | 890 | 540 | 3.0 | 6.10 | 50 | 0.03 | 1058 | 8 | 130 | 45 | 150 | 220 | 140 | No | No | 0.2 |
| N-1 | 890 | 540 | 3.0 | 5.45 | 50 | 0.03 | 885 | 8 | 130 | 45 | 150 | 220 | 140 | No | No | 0.2 |
| O-1 | 890 | 540 | 3.0 | 4.98 | 50 | 0.03 | 918 | 8 | 130 | 45 | 150 | 220 | 140 | No | No | 0.2 |
| P-1 | 890 | 540 | 3.0 | 5.58 | 50 | 0.03 | 1024 | 8 | 130 | 45 | 150 | 220 | 140 | No | No | 0.2 |
| Q-1 | 890 | 540 | 3.0 | 4.35 | 50 | 0.03 | 935 | 8 | 130 | 45 | 150 | 220 | 140 | No | No | 0.2 |
| R-1 | 890 | 540 | 3.0 | 3.27 | 50 | 0.03 | 945 | 8 | 130 | 45 | 150 | 220 | 140 | No | No | 0.2 |
| S-1 | 890 | 540 | 3.0 | 3.85 | 50 | 0.03 | 1034 | 8 | 130 | 45 | 150 | 220 | 140 | No | No | 0.2 |
| T-1 | 890 | 540 | 3.0 | 6.34 | 50 | 0.03 | 953 | 8 | 130 | 45 | 150 | 220 | 140 | No | No | 0.2 |
| U-1 | 890 | 540 | 3.0 | 3.11 | 50 | 0.03 | 861 | 8 | 130 | 45 | 150 | 220 | 140 | No | No | 0.2 |
| V-1 | 890 | 540 | 3.0 | 3.89 | 50 | 0.03 | 1091 | 8 | 130 | 45 | 150 | 220 | 140 | No | No | 0.2 |
| W-1 | 890 | 540 | 3.0 | 4.34 | 50 | 0.03 | 1024 | 8 | 130 | 45 | 150 | 220 | 140 | No | No | 0.2 |
| X-1 | 890 | 540 | 3.0 | 3.35 | 50 | 0.03 | 1046 | 8 | 130 | 45 | 150 | 220 | 140 | No | No | 0.2 |
| Y-1 | 890 | 540 | 3.0 | 3.91 | 50 | 0.03 | 927 | 8 | 130 | 45 | 150 | 220 | 140 | No | No | 0.2 |
| Z-1 | 890 | 540 | 3.0 | 3.40 | 50 | 0.03 | 918 | 8 | 130 | 45 | 150 | 220 | 140 | No | No | 0.2 |
| AA-1 | 890 | 540 | 3.0 | 5.86 | 50 | 0.03 | 901 | 8 | 130 | 45 | 150 | 220 | 140 | No | No | 0.2 |
| AB-1 | 890 | 540 | 3.0 | 4.59 | 50 | 0.03 | 1058 | 8 | 130 | 45 | 150 | 220 | 140 | No | No | 0.2 |
| AC-1 | 890 | 540 | 3.0 | 5.67 | 50 | 0.03 | 927 | 8 | 130 | 45 | 150 | 220 | 140 | No | No | 0.2 |
| AD-1 | 890 | 540 | 3.0 | 5.13 | 50 | 0.03 | 963 | 8 | 130 | 45 | 150 | 220 | 140 | No | No | 0.2 |
| AE-1 | 890 | 540 | 3.0 | 5.75 | 50 | 0.03 | 945 | 8 | 130 | 45 | 150 | 220 | 140 | No | No | 0.2 |
| AF-1 | 890 | 540 | 3.0 | 5.50 | 50 | 0.03 | 972 | 8 | 130 | 45 | 150 | 220 | 140 | No | No | 0.2 |
| AG-1 | 890 | 540 | 3.0 | 3.57 | 50 | 0.03 | 953 | 8 | 130 | 45 | 150 | 220 | 140 | No | No | 0.2 |
| AH-1 | 890 | 540 | 3.0 | 4.33 | 50 | 0.03 | 1034 | 8 | 130 | 45 | 150 | 220 | 140 | No | No | 0.2 |
| AI-1 | 890 | 540 | 3.0 | 4.05 | 50 | 0.03 | 1024 | 8 | 130 | 45 | 150 | 220 | 140 | No | No | 0.2 |
| AJ-1 | 890 | 540 | 3.0 | 3.87 | 50 | 0.03 | 918 | 8 | 130 | 45 | 150 | 220 | 140 | No | No | 0.2 |
| AK-1 | 890 | 540 | 3.0 | 4.63 | 50 | 0.03 | 935 | 8 | 130 | 45 | 150 | 220 | 140 | No | No | 0.2 |
| AL-1 | 890 | 540 | 3.0 | 5.18 | 50 | 0.03 | 983 | 8 | 130 | 45 | 150 | 220 | 140 | No | No | 0.2 |
| AM-1 | 890 | 540 | 3.0 | 4.29 | 50 | 0.03 | 1003 | 8 | 130 | 45 | 150 | 220 | 140 | No | No | 0.2 |
| AN-1 | 890 | 540 | 3.0 | 6.25 | 50 | 0.03 | 1003 | 8 | 130 | 45 | 150 | 220 | 140 | No | No | 0.2 |
| AO-1 | 890 | 540 | 3.0 | 6.25 | 50 | 0.03 | 892 | 8 | 130 | 45 | 150 | 220 | 140 | No | No | 0.2 |
| AP-1 | 890 | 540 | 3.0 | 5.21 | 50 | 0.03 | 1058 | 8 | 130 | 45 | 150 | 220 | 140 | No | No | 0.2 |
| AQ-1 | 890 | 540 | 3.0 | 5.61 | 50 | 0.03 | 901 | 8 | 130 | 45 | 150 | 220 | 140 | No | No | 0.2 |
| AR-1 | 890 | 540 | 3.0 | 6.59 | 50 | 0.03 | 972 | 8 | 130 | 45 | 150 | 220 | 140 | No | No | 0.2 |
| AS-1 | 890 | 540 | 3.0 | 4.82 | 50 | 0.03 | 892 | 8 | 130 | 45 | 150 | 220 | 140 | No | No | 0.2 |
| AT-1 | 890 | 540 | 3.0 | 4.08 | 50 | 0.03 | 877 | 8 | 130 | 45 | 150 | 220 | 140 | No | No | 0.2 |
| AU-1 | 890 | 540 | 3.0 | 3.94 | 50 | 0.03 | 963 | 8 | 130 | 45 | 150 | 220 | 140 | No | No | 0.2 |

| No. | Total of ferrite, pearlite, and bainite (%) | Retained austenite (%) | A Tempered martensite (%) | B Martensite (%) | A + B | First depth region block size (μm) | Second depth region block size (μm) | Third depth region block size (μm) | TS (MPa) | t-El (%) | λ (%) | LME resistance | Remarks |
|---|---|---|---|---|---|---|---|---|---|---|---|---|---|
| A-1 | 1.8 | 0.4 | 4.2 | 93.7 | 97.8 | 0.5 | 18.5 | 3.3 | 1646 | 8.0 | 39.8 | B | Ex. |
| B-1 | 9.8 | 0.1 | 1.6 | 88.4 | 90.1 | 0.6 | 13.7 | 4.3 | 1654 | 8.3 | 32.5 | B | Ex. |
| C-1 | 7.9 | 0.2 | 2.4 | 89.5 | 91.9 | 1.8 | 12.7 | 0.6 | 1858 | 7.4 | 25.8 | B | Ex. |
| D-1 | 6.6 | 0.7 | 6.8 | 85.9 | 92.7 | 2.6 | 16.1 | 5.3 | 2002 | 7.9 | 20.1 | B | Ex. |
| E-1 | 2.5 | 0.4 | 4.5 | 92.6 | 97.1 | 3.9 | 17.0 | 1.7 | 2014 | 7.7 | 20.2 | B | Ex. |
| F-1 | 8.1 | 0.1 | 0.9 | 90.9 | 91.8 | 3.0 | 12.1 | 0.3 | 1595 | 8.6 | 36.2 | B | Ex. |
| G-1 | 3.5 | 0.2 | 2.2 | 94.1 | 96.3 | 2.3 | 18.0 | 0.5 | 1803 | 7.8 | 30.5 | B | Ex. |
| H-1 | 9.6 | 0.2 | 2.3 | 87.9 | 90.2 | 4.0 | 6.2 | 3.6 | 1842 | 8.3 | 25.7 | B | Ex. |
| I-1 | 3.7 | 0.2 | 2.9 | 93.1 | 96.1 | 3.7 | 13.8 | 1.7 | 1890 | 7.4 | 26.0 | B | Ex. |
| J-1 | 8.8 | 0.1 | 0.8 | 90.4 | 91.1 | 2.0 | 13.2 | 1.4 | 1558 | 8.8 | 37.1 | B | Ex. |
| K-1 | 8.6 | 1.6 | 15.2 | 74.6 | 89.8 | 2.7 | 17.3 | 1.1 | 1983 | 7.7 | 20.6 | B | Ex. |
| L-1 | 0.5 | 0.8 | 8.4 | 90.4 | 98.7 | 2.1 | 7.8 | 3.0 | 2011 | 7.9 | 20.6 | B | Ex. |

TABLE 2-continued

| | | | | | | | | | | | | | |
|---|---|---|---|---|---|---|---|---|---|---|---|---|---|
| M-1 | 8.9 | 0.4 | 4.1 | 86.7 | 90.7 | 3.4 | 10.4 | 5.7 | 2017 | 7.3 | 20.1 | B | Ex. |
| N-1 | 8.9 | 0.0 | 0.4 | 90.7 | 91.1 | 1.3 | 12.7 | 1.7 | 1542 | 9.9 | 37.6 | B | Ex. |
| O-1 | 9.3 | 0.3 | 3.4 | 87.1 | 90.4 | 3.7 | 7.8 | 4.2 | 1631 | 9.0 | 33.8 | B | Ex. |
| P-1 | 0.3 | 1.0 | 10.7 | 88.0 | 98.7 | 1.8 | 11.4 | 2.3 | 2009 | 7.0 | 20.7 | B | Ex. |
| Q-1 | 8.7 | 0.1 | 1.4 | 89.8 | 91.2 | 3.1 | 9.8 | 4.2 | 1697 | 8.5 | 31.7 | B | Ex. |
| R-1 | 8.9 | 0.1 | 1.6 | 89.4 | 91.0 | 0.9 | 18.5 | 3.1 | 1727 | 8.6 | 30.4 | B | Ex. |
| S-1 | 9.4 | 0.2 | 2.4 | 87.9 | 90.4 | 3.3 | 18.8 | 0.9 | 2004 | 7.3 | 20.2 | B | Ex. |
| T-1 | 1.2 | 0.3 | 3.5 | 95.0 | 98.5 | 1.1 | 7.3 | 2.2 | 1864 | 7.6 | 28.5 | B | Ex. |
| U-1 | 15.2 | 0.0 | 0.7 | 84.0 | 84.8 | 3.8 | 9.8 | 4.4 | 1185 | 11.1 | 41.6 | B | Comp. ex. |
| V-1 | 8.2 | 0.6 | 5.3 | 85.9 | 91.2 | 0.6 | 17.9 | 4.0 | 2194 | 7.2 | 12.3 | NG | Comp. ex. |
| W-1 | 1.2 | 0.7 | 6.9 | 91.3 | 98.1 | 0.1 | 5.5 | 1.3 | 2105 | 7.7 | 15.4 | NG | Comp. ex. |
| X-1 | 40.6 | 0.8 | 6.1 | 52.5 | 58.6 | 4.5 | 19.3 | 4.0 | 1059 | 14.7 | 19.1 | B | Comp. ex. |
| Y-1 | 0.3 | 0.4 | 4.8 | 94.6 | 99.3 | 5.5 | 18.3 | 1.6 | 1782 | 7.5 | 18.6 | NG | Comp. ex. |
| Z-1 | 8.9 | 0.1 | 1.5 | 89.5 | 91.0 | 3.4 | 16.2 | 6.8 | 1642 | 9.2 | 33.7 | NG | Comp. ex. |
| AA-1 | 9.9 | 0.1 | 0.8 | 89.2 | 90.0 | 2.6 | 4.9 | 2.2 | 1570 | 8.9 | 9.6 | NG | Comp. ex. |
| AB-1 | 13.5 | 1.5 | 13.4 | 71.6 | 85.0 | 4.5 | 7.2 | 3.9 | 1157 | 11.5 | 45.0 | B | Comp. ex. |
| AC-1 | 4.1 | 0.1 | 1.7 | 94.1 | 95.8 | 3.6 | 3.2 | 3.0 | 1736 | 7.8 | 33.3 | NG | Comp. ex. |
| AD-1 | 3.8 | 0.2 | 3.0 | 93.0 | 96.0 | 4.9 | 16.0 | 4.8 | 1864 | 8.4 | 17.3 | B | Ref. ex. |
| AE-1 | 4.6 | 11.7 | 1.1 | 82.6 | 83.7 | 3.0 | 19.7 | 5.4 | 1771 | 9.9 | 13.3 | B | Ref. ex. |
| AF-1 | 2.2 | 0.3 | 3.5 | 94.0 | 97.5 | 2.3 | 9.8 | 3.0 | 1918 | 8.0 | 12.5 | B | Ref. ex. |
| AG-1 | 9.3 | 0.1 | 1.6 | 89.0 | 90.6 | 3.5 | 15.4 | 2.0 | 1740 | 8.1 | 17.9 | B | Ref. ex. |
| AH-1 | 0.2 | 1.4 | 14.6 | 83.8 | 98.4 | 4.6 | 12.7 | 4.2 | 2133 | 7.3 | 13.7 | B | Ref. ex. |
| AI-1 | 0.4 | 0.8 | 8.6 | 90.1 | 98.8 | 4.9 | 13.0 | 2.7 | 2112 | 7.2 | 14.9 | B | Ref. ex. |
| AJ-1 | 1.5 | 0.2 | 2.3 | 96.0 | 98.3 | 4.4 | 12.5 | 1.8 | 1741 | 8.1 | 14.9 | B | Ref. ex. |
| AK-1 | 9.7 | 0.1 | 1.7 | 88.5 | 90.2 | 4.8 | 10.2 | 2.8 | 1682 | 9.0 | 16.3 | B | Ref. ex. |
| AL-1 | 0.5 | 0.5 | 6.3 | 92.6 | 99.0 | 2.5 | 18.2 | 1.4 | 1973 | 7.4 | 17.2 | B | Ref. ex. |
| AM-1 | 1.8 | 0.4 | 4.9 | 92.9 | 97.8 | 4.1 | 16.2 | 5.8 | 2026 | 7.9 | 19.6 | B | Ref. ex. |
| AN-1 | 0.5 | 0.6 | 7.0 | 91.9 | 98.9 | 2.8 | 19.4 | 4.3 | 2035 | 7.2 | 19.2 | B | Ref. ex. |
| AO-1 | 7.5 | 0.1 | 1.3 | 91.1 | 92.4 | 3.6 | 12.9 | 2.6 | 1575 | 9.0 | 17.7 | B | Ref. ex. |
| AP-1 | 0.3 | 1.3 | 13.0 | 85.4 | 98.4 | 0.4 | 19.8 | 4.2 | 2215 | 7.0 | 9.1 | B | Ref. ex. |
| AQ-1 | 0.8 | 0.1 | 1.6 | 97.4 | 99.1 | 2.6 | 12.1 | 3.5 | 1690 | 8.1 | 18.3 | B | Ref. ex. |
| AR-1 | 0.0 | 0.7 | 8.7 | 90.5 | 99.3 | 1.2 | 17.2 | 5.4 | 1942 | 7.8 | 14.6 | B | Ref. ex. |
| AS-1 | 9.8 | 0.0 | 0.7 | 89.4 | 90.2 | 2.2 | 13.1 | 2.3 | 1549 | 9.3 | 16.4 | B | Ref. ex. |
| AT-1 | 3.7 | 0.0 | 0.6 | 95.7 | 96.3 | 1.7 | 16.0 | 2.5 | 1568 | 8.8 | 14.8 | B | Ref. ex. |
| AU-1 | 8.2 | 0.2 | 2.6 | 89.0 | 91.6 | 2.7 | 18.0 | 3.7 | 1787 | 8.0 | 15.8 | B | Ref. ex. |

Underlines indicate outside scope of present invention.

Referring to Tables 2, Example U-1 had a low C content, therefore the tensile strength was less than 1200 MPa. Example V-1 had a high C content, therefore the LME resistance fell. Example W-1 had a high Si content, therefore the hole expandability fell along with the increase of the tensile strength and, further, the LME resistance fell. Example X-1 had a low Mn content, therefore the tensile strength was less than 1200 MPa. Example Y-1 had a high Mn content, therefore the hole expandability fell along with the increase of the tensile strength and, further, the LME resistance fell. Example Z-1 had a high P content, therefore the steel sheet ended up becoming brittle and the LME resistance fell. Example AA-1 had a high S content, therefore the LME resistance fell. Example AB-1 had a high Al content, therefore ferrite transformation, etc., was excessively promoted and a sufficient tensile strength could not be obtained. Example AC-1 had a high N content, therefore the block size at the steel sheet surface layer could not be controlled to a gradient in the thickness direction and the LME resistance fell. On the other hand, Examples AD-1 to AU-1 were excellent in tensile strengths and LME resistances, but were respectively high in Ni, Cr, O, Ti, B, V, Cu, W, Ta, Sn, Sb, As, Mg, Ca, Y, Zr, La, and Ce contents, therefore sufficient hole expandabilities could not be achieved. These examples solve the technical problem of the present invention of "providing steel sheet high in strength and excellent in weldability", but the contents of the elements are outside the scope of the present invention, therefore they are designated as reference examples.

In contrast to this, in Examples A-1 to T-1, by suitably controlling the chemical compositions and structures of the steel sheets, it was possible to obtain steel sheets having high strength and excellent LME resistance and improved in total elongation and hole expandability as well.

Example 2

Furthermore, to investigate the production conditions, the Steel Types A to T recognized as being excellent in characteristics in Tables 2 were thermomechanically treated under the production conditions described in Tables 3 to prepare thickness 1.4 mm cold rolled steel sheets which were evaluated for the characteristics of the steel sheets after cold rolled annealing. Here, the plated steel sheets were held at the temperatures shown in Tables 3 after dipping the steel sheets in a hot dip galvanizing bath and formed hot dip galvanized steel sheets when the holding temperatures were 450 to less than 470° C. and formed hot dip galvannealed steel sheets giving alloyed plating layers of iron and zinc to the surfaces of the steel sheets when the holding temperatures were 470° C. or more. Further, in the cold rolled annealing, while cooling down to room temperature the steel sheets which had been held at the respective dwell temperatures, the steel sheets which were once cooled down to 150° C. were reheated and held there for 2 seconds or more as tempering treatment. The obtained results are shown in Tables 3. The methods of evaluation of the characteristics are similar to the case of Example 1.

TABLE 3

| | | | | | | Cold rolling | | Cold rolled annealing | | | | | | | | | |
|---|---|---|---|---|---|---|---|---|---|---|---|---|---|---|---|---|---|
| | | | | | | | | 740 to 900° C. | | | | | | | | | |
| No. | Finish rolling completion temp. (° C.) | Coiling temp. (° C.) | Am't of removal of steel sheet surface layer (μm) | Thickness of internal oxide layer before cold rolling (μm) | Cold rolling reduction (%) | Coefficient of friction of lubrication oil | Rolling load ton/m | Dew point | Holding time | Average cooling rate from 750° C. to 550° C. (° C./s) | Cooling stop temp. (° C.) | Dwell temp. (° C.) | Dwell time (s) | Tempering (° C.) | Plating | Holding temp. after dipping in plating bath (° C.) | Skin pass rolling reduction (%) |
| A-2 | 818 | 572 | 1.13 | 9.74 | 59 | 0.09 | 982 | −13 | 291 | 81 | 416 | 530 | 514 | 241 | No | — | 0.3 |
| B-2 | 791 | 522 | 0.39 | 5.30 | 33 | 0.06 | 857 | −10 | 84 | 49 | 417 | 540 | 253 | 383 | No | — | 0.9 |
| C-2 | 677 | 677 | 2.19 | 3.56 | 24 | 0.03 | 822 | 10 | 162 | 84 | 359 | 355 | 324 | 273 | Yes | 505 | 0.9 |
| D-2 | 935 | 645 | 2.00 | 3.44 | 78 | 0.02 | 1334 | −3 | 184 | 61 | 339 | 390 | 453 | 308 | Yes | 475 | 0.4 |
| E-2 | 724 | 677 | 0.11 | 1.21 | 41 | 0.03 | 910 | 11 | 37 | 38 | 161 | 397 | 206 | 277 | No | — | 0.2 |
| F-2 | 796 | 483 | 4.58 | 0.79 | 85 | 0.07 | 1251 | −6 | 224 | 70 | 246 | 501 | 258 | 237 | No | — | 0.3 |
| G-2 | 872 | 531 | 4.70 | 5.87 | 44 | 0.02 | 882 | 9 | 286 | 38 | 266 | 373 | 488 | 170 | No | — | 0.9 |
| H-2 | 780 | 651 | 0.55 | 2.25 | 74 | 0.09 | 1227 | −24 | 119 | 46 | 82 | 479 | 65 | 172 | Yes | 517 | 0.2 |
| I-2 | 857 | 627 | 2.53 | 7.78 | 50 | 0.01 | 968 | −19 | 157 | 94 | 121 | 389 | 128 | 293 | Yes | 481 | 0.3 |
| J-2 | 739 | 512 | 3.57 | 5.26 | 78 | 0.03 | 1172 | −15 | 261 | 44 | 153 | 420 | 380 | 313 | Yes | 534 | 0.5 |
| K-2 | 842 | 516 | 1.72 | 3.31 | 56 | 0.01 | 1092 | 0 | 58 | 57 | 296 | 464 | 480 | 262 | Yes | 537 | 0.9 |
| L-2 | 727 | 638 | 2.62 | 4.48 | 63 | 0.08 | 1135 | −11 | 106 | 57 | 307 | 414 | 342 | 333 | No | — | 0.8 |
| M-2 | 924 | 556 | 0.92 | 2.74 | 41 | 0.05 | 963 | 13 | 79 | 75 | 375 | 529 | 583 | 356 | No | — | 0.8 |
| N-2 | 749 | 659 | 4.54 | 8.32 | 62 | 0.09 | 1000 | −28 | 243 | 45 | 475 | 430 | 29 | 197 | Yes | 473 | 0.5 |
| O-2 | 704 | 612 | 1.20 | 8.02 | 50 | 0.01 | 922 | 15 | 117 | 91 | 291 | 548 | 301 | 226 | No | — | 0.3 |
| P-2 | 927 | 621 | 2.59 | 9.43 | 95 | 0.07 | 1470 | −9 | 174 | 12 | 466 | 504 | 42 | 182 | No | — | 0.5 |
| Q-2 | 881 | 487 | 3.40 | 0.58 | 76 | 0.03 | 1199 | 13 | 133 | 42 | 106 | 370 | 435 | 361 | No | — | 0.9 |
| R-2 | 804 | 655 | 2.69 | 4.11 | 58 | 0.03 | 1021 | 19 | 135 | 93 | 259 | 518 | 311 | 158 | Yes | 491 | 0.3 |
| S-2 | 703 | 561 | 3.06 | 4.60 | 74 | 0.06 | 1278 | 8 | 184 | 92 | 296 | 413 | 441 | 382 | No | — | 0.5 |
| T-2 | 733 | 633 | 3.94 | 5.16 | 87 | 0.05 | 1325 | −18 | 215 | 78 | 505 | 461 | 214 | 211 | Yes | 459 | 0.9 |
| A-3 | 874 | 601 | 0.46 | 9.52 | 36 | 0.06 | 847 | −15 | 101 | 9 | 106 | 471 | 356 | 336 | Yes | 536 | 0.6 |
| B-3 | 906 | 582 | 3.16 | 7.01 | 32 | 0.07 | 848 | 2 | 149 | 62 | 210 | 406 | 146 | 297 | Yes | 506 | 0.7 |
| C-3 | 843 | 536 | 1.10 | 7.68 | 47 | 0.03 | 957 | 4 | 201 | 71 | 172 | 383 | 245 | 266 | No | — | 0.6 |
| D-3 | 787 | 584 | 1.93 | 3.38 | 70 | 0.01 | 1255 | −1 | 321 | 68 | 52 | 475 | 362 | 383 | Yes | 501 | 0.6 |
| E-3 | 876 | 535 | 3.13 | 4.83 | 48 | 0.07 | 984 | −1 | 148 | 68 | 504 | 508 | 378 | 225 | Yes | 544 | 0.6 |
| F-3 | 766 | 672 | 4.33 | 5.42 | 71 | 0.06 | 1107 | 2 | 51 | 36 | 172 | 444 | 533 | 178 | No | — | 0.4 |
| G-3 | 697 | 545 | 3.14 | 4.89 | 93 | 0.09 | 1378 | 1 | 264 | 49 | 320 | 392 | 437 | 344 | Yes | 517 | 0.3 |
| H-3 | 748 | 596 | 1.48 | 7.73 | 37 | 0.02 | 848 | −6 | 285 | 50 | 240 | 450 | 92 | 276 | Yes | 506 | 0.2 |
| I-3 | 666 | 717 | 1.56 | 11.12 | 83 | 0.09 | 1306 | −17 | 81 | 39 | 384 | 509 | 193 | 239 | No | — | 0.7 |
| J-3 | 890 | 603 | 0.79 | 6.61 | 27 | 0.07 | 865 | 10 | 217 | 61 | 366 | 533 | 290 | 253 | No | — | 0.4 |
| K-3 | 795 | 506 | 0.76 | 6.38 | 55 | 0.09 | 1083 | 18 | 62 | 48 | 521 | 435 | 556 | 178 | No | — | 0.4 |
| L-3 | 826 | 686 | 5.46 | 6.67 | 87 | 0.02 | 1375 | −3 | 241 | 22 | 438 | 366 | 145 | 202 | Yes | 462 | 0.4 |
| M-3 | 690 | 617 | 3.61 | 4.75 | 85 | 0.07 | 1404 | 14 | 339 | 86 | 226 | 494 | 405 | 333 | Yes | 509 | 0.2 |
| N-3 | 824 | 592 | 0.10 | 1.16 | 71 | 0.01 | 1090 | 16 | 117 | 50 | 73 | 448 | 67 | 344 | Yes | 521 | 0.8 |
| O-3 | 921 | 634 | 3.92 | 5.19 | 49 | 0.09 | 903 | −10 | 253 | 36 | 433 | 490 | 224 | 301 | Yes | 475 | 0.7 |
| P-3 | 675 | 557 | 4.30 | 5.51 | 79 | 0.09 | 1315 | 6 | 65 | 53 | 172 | 434 | 128 | 367 | No | — | 0.2 |
| Q-3 | 682 | 534 | 1.74 | 2.83 | 38 | 0.03 | 811 | −6 | 272 | 52 | 464 | 415 | 552 | 248 | No | — | 0.8 |
| R-3 | 895 | 746 | 2.34 | 14.49 | 65 | 0.02 | 1095 | 7 | 214 | 81 | 65 | 477 | 521 | 203 | No | — | 0.8 |
| S-3 | 861 | 565 | 4.19 | 9.24 | 64 | 0.03 | 1174 | −14 | 150 | 51 | 189 | 361 | 161 | 376 | Yes | 496 | 0.7 |
| T-3 | 764 | 596 | 1.48 | 4.74 | 68 | 0.02 | 1136 | 7 | 97 | 74 | 39 | 491 | 118 | 324 | No | — | 0.6 |
| A-4 | 923 | 592 | 0.00 | 5.59 | 74 | 0.04 | 1136 | −4 | 287 | 43 | 397 | 447 | 180 | 340 | No | — | 0.5 |
| B-4 | 694 | 605 | 0.11 | 7.81 | 38 | 0.02 | 810 | 25 | 73 | 59 | 468 | 397 | 225 | 363 | Yes | 538 | 0.6 |
| C-4 | 901 | 678 | 0.11 | 9.54 | 65 | 0.05 | 1130 | −5 | 239 | 70 | 316 | 541 | 444 | 310 | Yes | 509 | 0.4 |
| D-4 | 788 | 509 | 4.15 | 8.17 | 47 | 0.02 | 1024 | 17 | 183 | 36 | 460 | 497 | 383 | 166 | Yes | 498 | 0.4 |
| E-4 | 829 | 624 | 1.43 | 9.26 | 48 | 0.01 | 987 | 3 | 206 | 35 | 243 | 459 | 352 | 352 | No | — | 0.9 |
| F-4 | 885 | 633 | 2.19 | 9.25 | 52 | 0.06 | 917 | 12 | 92 | 44 | 359 | 527 | 127 | 259 | Yes | 467 | 0.5 |
| G-4 | 814 | 654 | 3.90 | 6.73 | 53 | 0.02 | 977 | 4 | 268 | 75 | 217 | 403 | 283 | 281 | Yes | 548 | 0.8 |
| H-4 | 768 | 629 | 6.54 | 9.14 | 33 | 0.10 | 808 | 12 | 185 | 58 | 528 | 487 | 511 | 215 | Yes | 474 | 0.4 |
| I-4 | 843 | 587 | 2.36 | 4.19 | 58 | 0.09 | 1048 | −16 | 132 | 65 | 56 | 511 | 174 | 307 | No | — | 0.9 |
| J-4 | 899 | 568 | 4.62 | 5.89 | 42 | 0.09 | 815 | −2 | 236 | 48 | 348 | 400 | 253 | 224 | No | — | 0.7 |
| K-4 | 742 | 575 | 0.00 | 5.90 | 46 | 0.04 | 995 | 17 | 149 | 96 | 178 | 438 | 164 | 227 | No | — | 0.7 |
| L-4 | 908 | 641 | 0.98 | 2.29 | 72 | 0.08 | 1225 | 14 | 240 | 37 | 414 | 375 | 380 | 207 | Yes | 520 | 0.5 |
| M-4 | 930 | 543 | 4.69 | 5.96 | 59 | 0.09 | 1147 | −12 | 253 | 76 | 309 | 457 | 448 | 366 | Yes | 456 | 0.8 |
| N-4 | 934 | 630 | 3.57 | 8.99 | 84 | 0.05 | 1221 | 6 | 203 | 40 | 368 | 378 | 303 | 247 | No | — | 0.6 |
| O-4 | 742 | 593 | 0.98 | 8.67 | 60 | 0.02 | 1018 | 29 | 70 | 96 | 185 | 422 | 538 | 383 | No | — | 0.3 |
| P-4 | 722 | 668 | 4.47 | 8.58 | 54 | 0.07 | 1066 | 5 | 90 | 62 | 499 | 480 | 280 | 278 | Yes | 464 | 0.8 |
| Q-4 | 676 | 551 | 2.09 | 6.25 | 88 | 0.01 | 1313 | 9 | 159 | 46 | 521 | 389 | 501 | 194 | Yes | 498 | 0.2 |
| R-4 | 714 | 662 | 2.04 | 5.87 | 40 | 0.03 | 842 | −1 | 109 | 77 | 149 | 419 | 409 | 180 | No | — | 0.6 |
| S-4 | 880 | 557 | 3.18 | 7.11 | 33 | 0.09 | 866 | 14 | 124 | 51 | 67 | 472 | 341 | 185 | Yes | 513 | 0.1 |
| T-4 | 801 | 516 | 3.54 | 5.34 | 43 | 0.02 | 887 | 1 | 31 | 53 | 138 | 533 | 59 | 274 | Yes | 490 | 1.0 |
| A-5 | 932 | 574 | 0.01 | 5.42 | 54 | 0.03 | 966 | 2 | 151 | 52 | 199 | 417 | 244 | 308 | No | — | 0.3 |
| K-5 | 764 | 548 | 0.01 | 5.69 | 51 | 0.03 | 1027 | −1 | 213 | 47 | 223 | 392 | 119 | 161 | No | — | 0.2 |

TABLE 3-continued

| No. | Total of ferrite, pearlite, and bainite (%) | Retained austenite (%) | A Tempered martensite (%) | B Martensite (%) | A + B | First depth region block size (μm) | Second depth region block size (μm) | Third depth region block size (μm) | TS (MPa) | t-El (%) | λ (%) | LME resistance | Remarks |
|---|---|---|---|---|---|---|---|---|---|---|---|---|---|
| A-2 | 8.6 | 0.5 | 0.5 | 90.4 | 90.9 | 0.5 | 18.5 | 3.3 | 1567 | 8.3 | 36.9 | C | Ex. |
| B-2 | 9.5 | 0.1 | 0.2 | 90.2 | 90.4 | 0.6 | 13.7 | 4.3 | 1661 | 8.3 | 32.5 | C | Ex. |
| C-2 | 8.4 | 0.2 | 0.9 | 90.5 | 91.4 | 6.8 | 12.7 | 2.6 | 1853 | 7.4 | 25.8 | NG | Comp. ex. |
| D-2 | 5.4 | 0.7 | 0.3 | 93.6 | 93.9 | 2.6 | 16.1 | 5.3 | 2159 | 7.4 | 23.2 | A | Ex. |
| E-2 | 6.6 | 0.5 | 6.1 | 86.8 | 92.9 | 3.9 | 5.4 | 1.7 | 1944 | 7.9 | 22.6 | NG | Comp. ex. |
| F-2 | 5.4 | 0.1 | 6.9 | 87.7 | 94.5 | 13.1 | 12.1 | 3.3 | 1624 | 8.4 | 37.5 | NG | Comp. ex. |
| G-2 | 4.1 | 0.2 | 22.3 | 73.4 | 95.7 | 2.3 | 18 | 0.5 | 1755 | 7.9 | 32.4 | B | Ex. |
| H-2 | 9.5 | 0.2 | 0.6 | 89.7 | 90.3 | 4 | 3.6 | 3.6 | 1846 | 8.3 | 25.6 | NG | Comp. ex. |
| I-2 | 1.8 | 0.2 | 1.7 | 96.3 | 98.0 | 3.7 | 13.8 | 1.7 | 1923 | 7.3 | 25.1 | B | Ex. |
| J-2 | 9.6 | 0.1 | 0.9 | 89.5 | 90.3 | 2 | 13.2 | 1.4 | 1548 | 8.9 | 36.7 | B | Ex. |
| K-2 | 7.7 | 1.5 | 1.0 | 89.8 | 90.8 | 2.7 | 17.3 | 1.1 | 2037 | 7.6 | 28.5 | B | Ex. |
| L-2 | 9.2 | 1.1 | 0.8 | 88.9 | 89.7 | 2.1 | 7.8 | 3 | 1916 | 8.2 | 23.0 | B | Ex. |
| M-2 | 5.7 | 0.4 | 0.5 | 93.4 | 93.9 | 3.4 | 10.4 | 5.7 | 2149 | 7 | 23.6 | B | Ex. |
| N-2 | 8.9 | 0.0 | 0.2 | 90.9 | 91.1 | 1.3 | 4.7 | 1.7 | 1542 | 9.9 | 37.6 | NG | Comp. ex. |
| O-2 | 8.1 | 0.3 | 53.3 | 38.3 | 91.6 | 3.7 | 7.8 | 4.2 | 1603 | 9.1 | 35.9 | B | Ex. |
| P-2 | 8.0 | 1.3 | 0.6 | 90.1 | 90.7 | 12.3 | 12.5 | 11.8 | 1995 | 7.1 | 20.2 | NG | Comp. ex. |
| Q-2 | 9.3 | 0.1 | 0.6 | 90.0 | 90.6 | 11.1 | 9.8 | 4.2 | 1689 | 8.5 | 31.6 | NG | Comp. ex. |
| R-2 | 4.6 | 0.1 | 13.6 | 81.6 | 95.3 | 0.9 | 18.5 | 3.1 | 1776 | 8.4 | 31.1 | B | Ex. |
| S-2 | 5.1 | 0.2 | 36.9 | 57.8 | 94.7 | 3.3 | 18.8 | 0.9 | 2005 | 7.3 | 20.2 | B | Ex. |
| T-2 | 0.7 | 0.3 | 0.6 | 98.4 | 99.0 | 1.1 | 7.3 | 2.2 | 1876 | 7.6 | 28.0 | B | Ex. |
| A-3 | 8.6 | 0.4 | 1.8 | 89.2 | 91.0 | 0.5 | 18.5 | 3.3 | 1566 | 8.3 | 37.0 | B | Ex. |
| B-3 | 7.4 | 0.1 | 5.3 | 87.1 | 92.5 | 0.6 | 13.7 | 4.3 | 1682 | 8.2 | 33.3 | C | Ex. |
| C-3 | 5.2 | 0.2 | 3.6 | 91.0 | 94.6 | 1.8 | 12.7 | 0.6 | 1898 | 7.3 | 25.1 | B | Ex. |
| D-3 | 9.9 | 0.8 | 1.4 | 87.8 | 89.3 | 2.6 | 26.4 | 5.3 | 1173 | 12 | 50.2 | NG | Comp. ex. |
| E-3 | 6.1 | 0.5 | 0.3 | 93.1 | 93.4 | 3.9 | 17 | 1.7 | 1964 | 7.9 | 21.9 | C | Ex. |
| F-3 | 9.8 | 0.1 | 1.5 | 88.7 | 90.1 | 3 | 12.1 | 0.3 | 1573 | 8.7 | 35.6 | B | Ex. |
| G-3 | 6.8 | 0.2 | 69.1 | 23.9 | 93.0 | 15.2 | 14.8 | 15.1 | 1626 | 8.4 | 36.1 | NG | Comp. ex. |
| H-3 | 8.8 | 0.2 | 12.5 | 78.5 | 91.0 | 4 | 6.2 | 3.6 | 1839 | 8.3 | 26.2 | B | Ex. |
| I-3 | 7.2 | 0.3 | 0.3 | 92.2 | 92.5 | 3.7 | 13.8 | 1.7 | 1841 | 7.6 | 16.8 | C | Ex. |
| J-3 | 7.3 | 0.1 | 75.6 | 17.1 | 92.6 | 6.9 | 13.2 | 1.4 | 1495 | 9.1 | 41.2 | NG | Comp. ex. |
| K-3 | 7.7 | 1.5 | 1.0 | 89.8 | 90.8 | 2.7 | 17.3 | 1.1 | 2037 | 7.6 | 28.5 | C | Ex. |
| L-3 | 1.0 | 0.8 | 0.9 | 97.3 | 98.2 | 13.1 | 12.8 | 11.7 | 2045 | 7.8 | 28.6 | NG | Comp. ex. |
| M-3 | 7.1 | 0.4 | 16.8 | 75.6 | 92.5 | 3.4 | 20.8 | 5.7 | 1164 | 11.3 | 27.4 | NG | Comp. ex. |
| N-3 | 9.4 | 0.0 | 0.1 | 90.5 | 90.6 | 1.3 | 12.7 | 1.7 | 1537 | 9.9 | 37.3 | B | Ex. |
| O-3 | 8.6 | 0.3 | 0.7 | 90.4 | 91.1 | 3.7 | 7.8 | 4.2 | 1643 | 8.9 | 33.9 | C | Ex. |
| P-3 | 0.3 | 1.0 | 15.9 | 82.7 | 98.7 | 1.8 | 11.4 | 2.3 | 2079 | 6.8 | 26.8 | C | Ex. |
| Q-3 | 7.6 | 0.1 | 0.2 | 92.1 | 92.3 | 3.1 | 9.8 | 4.2 | 1714 | 8.4 | 31.8 | B | Ex. |
| R-3 | 5.2 | 0.1 | 0.3 | 94.4 | 94.7 | 0.9 | 18.5 | 3.1 | 1782 | 8.4 | 14.7 | C | Ex. |
| S-3 | 8.5 | 0.2 | 5.0 | 86.2 | 91.3 | 3.3 | 18.8 | 0.9 | 2014 | 7.3 | 24.9 | B | Ex. |
| T-3 | 0.7 | 0.3 | 0.4 | 98.6 | 99.0 | 1.1 | 7.3 | 2.2 | 1876 | 7.6 | 28.0 | B | Ex. |
| A-4 | 1.9 | 0.4 | 0.8 | 96.9 | 97.7 | 0.5 | 18.5 | 3.3 | 1647 | 8 | 16.9 | B | Ex. |
| B-4 | 9.5 | 0.1 | 0.4 | 90.0 | 90.4 | 0.6 | 23.7 | 4.3 | 1161 | 11 | 51.3 | NG | Comp. ex. |
| C-4 | 5.3 | 0.2 | 56.9 | 37.6 | 94.5 | 1.8 | 12.7 | 0.6 | 1755 | 7.7 | 31.6 | B | Ex. |
| D-4 | 9.2 | 0.8 | 0.6 | 89.4 | 90.0 | 2.6 | 16.1 | 5.3 | 2088 | 7.6 | 26.5 | B | Ex. |
| E-4 | 6.8 | 0.5 | 27.6 | 65.1 | 92.7 | 3.9 | 17 | 1.7 | 1899 | 8.1 | 24.5 | B | Ex. |
| F-4 | 8.3 | 0.1 | 72.6 | 19.0 | 91.6 | 3 | 12.1 | 0.3 | 1513 | 8.9 | 39.3 | B | Ex. |
| G-4 | 6.4 | 0.2 | 9.3 | 84.1 | 93.4 | 2.3 | 18 | 0.5 | 1747 | 8 | 31.2 | B | Ex. |
| H-4 | 9.7 | 0.2 | 0.8 | 89.3 | 90.1 | 7.1 | 6.2 | 3.6 | 1842 | 8.3 | 25.6 | NG | Comp. ex. |
| I-4 | 9.3 | 0.3 | 0.6 | 89.8 | 90.4 | 3.7 | 13.8 | 1.7 | 1807 | 7.7 | 27.2 | C | Ex. |
| J-4 | 8.4 | 0.1 | 51.3 | 40.2 | 91.5 | 2 | 13.2 | 1.4 | 1508 | 9 | 39.4 | C | Ex. |
| K-4 | 9.4 | 1.7 | 25.2 | 63.7 | 88.9 | 2.7 | 17.3 | 1.1 | 1942 | 7.9 | 16.2 | B | Ex. |
| L-4 | 0.6 | 0.8 | 1.0 | 97.6 | 98.6 | 2.1 | 7.8 | 3 | 2051 | 7.7 | 23.8 | B | Ex. |
| M-4 | 6.8 | 0.4 | 72.1 | 20.7 | 92.8 | 3.4 | 10.4 | 5.7 | 1875 | 7.8 | 25.5 | C | Ex. |
| N-4 | 9.9 | 0.0 | 41.9 | 48.1 | 90.1 | 1.3 | 12.7 | 1.7 | 1518 | 10 | 37.5 | B | Ex. |
| O-4 | 1.3 | 0.2 | 5.6 | 92.9 | 98.5 | 3.7 | 21.9 | 4.2 | 1140 | 12 | 67.7 | NG | Comp. ex. |
| P-4 | 1.4 | 1.1 | 0.1 | 97.4 | 97.5 | 1.8 | 11.4 | 2.3 | 2111 | 6.8 | 22.5 | B | Ex. |
| Q-4 | 9.7 | 0.1 | 0.6 | 89.6 | 90.2 | 3.1 | 9.8 | 4.2 | 1684 | 8.5 | 31.5 | A | Ex. |
| R-4 | 5.5 | 0.1 | 1.5 | 92.8 | 94.4 | 0.9 | 18.5 | 3.1 | 1776 | 8.4 | 30.5 | B | Ex. |
| S-4 | 8.5 | 0.2 | 0.5 | 90.8 | 91.3 | 3.3 | 18.8 | 0.9 | 2024 | 7.3 | 24.0 | C | Ex. |
| T-4 | 1.0 | 0.3 | 2.8 | 96.0 | 98.7 | 1.1 | 4.1 | 2.2 | 1868 | 7.6 | 28.4 | NG | Comp. ex. |
| A-\\5 | 1.6 | 0.8 | 19.8 | 77.8 | 97.6 | 3.2 | 12.5 | 3.8 | 1528 | 9.8 | 25.8 | B | Ex. |
| K-5 | 8.8 | 2.8 | 21.6 | 66.8 | 88.4 | 2.9 | 18.4 | 2.7 | 1961 | 7.7 | 21.6 | B | Ex. |

Underlines indicate outside scope of present invention.

Referring to Tables 3, Examples C-2 and J-3 had low rolling reductions in the cold rolling, therefore the effect of crushing the oxides was not obtained and the block sizes in the first depth regions could not be sufficiently decreased. As a result, the LME resistances fell. Examples E-2 and T-4 had short holding times in the temperature region of 740 to 900° C. in the cold rolled annealing, therefore the block sizes in the second depth regions could not be controlled to the desired ranges. As a result, the LME resistances fell. Examples F-2 and Q-2 had low coiling temperatures, therefore the block sizes of the steel sheet surface layers could not be controlled to gradients after the cold rolled annealing and the LME resistances fell. This is believed to be due to the fact that it was not possible to produce sufficient oxides in the surface layers of the hot rolled steel sheets in the thickness direction and was not possible to promote the crushing and fine dispersion of oxides at the steel sheet surface layers in the subsequently pickling and cold rolling steps. Examples H-2 and N-2 had low dew points in the temperature region of 740 to 900° C. in cold rolled annealing, therefore the block sizes in the second depth regions could not be controlled to the desired ranges. As a result, the LME resistances fell.

Examples P-2 and G-3 had high rolling reductions in the cold rolling, therefore the desired grain size distributions were not obtained at the steel sheet surface layers after cold rolled annealing and the LME resistances fell. This is believed to be due to the fact that the oxide layers of the hot rolled steel sheet surface layers became extremely thin. Examples D-3 and M-3 had long holding times at the temperature region of 740 to 900° C. in the cold rolled annealing, therefore the block sizes at the second depth regions coarsened and the LME resistances fell. Examples L-3 and H-4 had large amounts of removal of the steel sheet surface layers by the pickling, therefore the desired grain size distributions could not be obtained at the steel sheet surface layers after cold rolled annealing and the LME resistances fell. This is believed to be due to the fact that since the amounts of removal of the steel sheet surface layers by the pickling were large, the amounts of crushed oxides present at the steel sheet surface layers after cold rolling became small. Examples B-4 and 0-4 had high dew points at the temperature region of 740 to 900° C. in the cold rolled annealing, therefore the block sizes at the second depth regions could not be controlled to the desired ranges. As a result, the LME resistances fell.

In contrast to this, in all of the examples according to the present invention, by suitably controlling in particular the coiling temperature, the amount of removal of the steel sheet surface layer by the pickling, the rolling reduction in the cold rolling, and the dew point and the holding time in a predetermined temperature region of the cold rolled annealing, it was possible to obtain a high strength and excellent LME resistance. For example, Examples A-4 and K-4 had zero amounts of removal of the steel sheet surface layers by the pickling, therefore had hole expansion values λ of less than 20.0%, but A-5 and K-5 in where the amounts of removal of the steel sheet surface layers by the pickling were 0.01 μm, the hole expansion values λ became 20% or more and accordingly the hole expandabilities were greatly improved. Further, even among the examples, a trend was seen of the LME resistance being better improved by controlling the coefficient of friction of the lubrication oil at the time of cold rolling to become lower and/or controlling the rolling load to become higher. For example, if the coefficient of friction was 0.08 or less and the rolling load was 1000 ton/m or more, the LME resistance could be judged as "B" or more in the evaluation and further if the coefficient of friction was 0.02 or less and the rolling load was 1300 ton/m or more, the LME resistance could be judged as "A" in the evaluation.

The invention claimed is:

1. A steel sheet having a chemical composition comprising, by mass %,

C: 0.20 to 0.40%,
Si: 0.01 to 0.95%,
Mn: 0.10 to 4.00%,
P: 0.0200% or less,
S: 0.0200% or less,
Al: 1.000% or less,
N: 0.0200% or less,
Co: 0 to 0.5000%,
Ni: 0 to 1.0000%,
Mo: 0 to 1.0000%,
Cr: 0 to 2.0000%,
O: 0 to 0.0200%,
Ti: 0 to 0.500%,
B: 0 to 0.0100%,
Nb: 0 to 0.5000%,
V: 0 to 0.5000%,
Cu: 0 to 0.5000%,
W: 0 to 0.1000%,
Ta: 0 to 0.1000%,
Sn: 0 to 0.0500%,
Sb: 0 to 0.0500%,
As: 0 to 0.0500%,
Mg: 0 to 0.0500%,
Ca: 0 to 0.0500%,
Y: 0 to 0.0500%,
Zr: 0 to 0.0500%,
La: 0 to 0.0500%,
Ce: 0 to 0.0500%, and
a balance of Fe and impurities, and
a microstructure containing, by area ratio,
a total of ferrite, pearlite, and bainite: 0 to 10.0% and
a total of martensite and tempered martensite: 80.0 to 100.0%,
wherein in a cross-sectional structure taken in a width direction perpendicular to a rolling direction,
a block size in a first depth region of 1 to 10 μm from a surface of the steel sheet is 5.0 μm or less,
a block size in a second depth region of 10 to 60 μm from the surface of the steel sheet is 6.0 to 20.0 μm, and
a block size in a third depth region of 60 μm to ¼ thickness from the surface of the steel sheet is less than 6.0 μm.

2. The steel sheet according to claim 1, wherein the chemical composition comprises, by mass %, one or more of Co: 0.0001 to 0.5000%,
Ni: 0.0001 to 1.0000%,
Mo: 0.0001 to 1.0000%,
Cr: 0.0001 to 2.0000%,
O: 0.0001 to 0.0200%,
Ti: 0.0001 to 0.500%,
B: 0.0001 to 0.0100%,
Nb: 0.0001 to 0.5000%,
V: 0.0001 to 0.5000%,
Cu: 0.0001 to 0.5000%,
W: 0.0001 to 0.1000%,
Ta: 0.0001 to 0.1000%,
Sn: 0.0001 to 0.0500%,
Sb: 0.0001 to 0.0500%,
As: 0.0001 to 0.0500%,
Mg: 0.0001 to 0.0500%,
Ca: 0.0001 to 0.0500%,
Y: 0.0001 to 0.0500%,
Zr: 0.0001 to 0.0500%,
La: 0.0001 to 0.0500%, and
Ce: 0.0001 to 0.0500%.

3. The steel sheet according to claim 1, wherein an area ratio of retained austenite in the microstructure is 10.0% or less.

4. The steel sheet according to claim 1, wherein a plating layer containing zinc, aluminum, magnesium, an alloy comprising any combination thereof, or an alloy of at least one of zinc, aluminum, or magnesium, and iron diffused from the steel sheet, is formed on at least one surface of the steel sheet.

5. A method for producing the steel sheet of claim 1, comprising a step of hot rolling a steel slab having a chemical composition according to claim 1, then coiling it at 500° C. or more, a step of pickling the obtained hot rolled steel sheet to remove oxide scale present on the surface of the hot rolled steel sheet, wherein an amount of removal of the surface layer of the hot rolled steel sheet is less than 5.00 μm, a step of cold rolling the hot rolled steel sheet by a rolling reduction of 30 to 90%, and an annealing step of holding the obtained cold rolled steel sheet in an atmosphere of a dew point of −20 to 20° C. at a temperature region of 740 to 900° C. for 40 to 300 seconds;

thereby producing the steel sheet of claim 1.

6. The method for producing the steel sheet according to claim 5, wherein, in the annealing step, a plating layer containing zinc, aluminum, magnesium, an alloy comprising any combination thereof, or an alloy of at least one of zinc, aluminum, or magnesium, and iron diffused from the steel sheet, is formed on at least one surface of the cold rolled steel sheet.

7. The steel sheet according to claim 2, wherein an area ratio of retained austenite in the microstructure is 10.0% or less.

8. The steel sheet according to claim 2, wherein a plating layer containing zinc, aluminum, magnesium, an alloy comprising any combination thereof, or an alloy of at least one of zinc, aluminum, or magnesium, and iron diffused from the steel sheet, is formed on at least one surface of the steel sheet.

9. The steel sheet according to claim 3, wherein a plating layer containing zinc, aluminum, magnesium, an alloy comprising any combination thereof, or an alloy of at least one of zinc, aluminum, or magnesium, and iron diffused from the steel sheet, is formed on at least one surface of the steel sheet.

10. A method for producing the steel sheet of claim 2, comprising a step of hot rolling a steel slab having a chemical composition according to claim 2, then coiling it at 500° C. or more, a step of pickling the obtained hot rolled steel sheet to remove oxide scale present on the surface of the hot rolled steel sheet, wherein an amount of removal of the surface layer of the hot rolled steel sheet is less than 5.00 μm, a step of cold rolling the hot rolled steel sheet by a rolling reduction of 30 to 90%, and an annealing step of holding the obtained cold rolled steel sheet in an atmosphere of a dew point of −20 to 20° C. at a temperature region of 740 to 900° C. for 40 to 300 seconds; thereby producing the steel sheet of claim 2.

* * * * *